United States Patent [19]

Kasuga

[11] 4,077,341

[45] Mar. 7, 1978

[54] BUILT IN BUTTONHOLER FOR A SEWING MACHINE

[75] Inventor: Norboru Kasuga, Hachioji, Japan

[73] Assignee: Janome Sewing Machine Co., Ltd., Tokyo, Japan

[21] Appl. No.: 713,573

[22] Filed: Aug. 11, 1976

Related U.S. Application Data

[63] Continuation-in-part of Ser. No. 711,078, Aug. 2, 1976.

[30] Foreign Application Priority Data

Aug. 19, 1975 Japan ..... 50/99756

[51] Int. Cl.[2] ..... D05B 3/02

[52] U.S. Cl. ..... 112/158 B

[58] Field of Search ..... 112/158 B, 158 A, 158 R, 112/158 C, 158 D

[56] References Cited

U.S. PATENT DOCUMENTS

| | | | |
|---|---|---|---|
| 3,149,591 | 9/1964 | Aiki et al. | 112/158 B |
| 3,754,521 | 8/1973 | Thuring | 112/158 B |

*Primary Examiner*—Werner H. Schroeder
*Assistant Examiner*—Peter Nerbun
*Attorney, Agent, or Firm*—Michael J. Striker

[57] ABSTRACT

A sewing machine has a shaft which is rotated relative to the machine frame in order vertically to reciprocate a needle and to rotate a pack of pattern cams. Two cam followers are axially displaceable along this pack and are engageable radially with the cams for controlling the stitch pattern of the needle. The sewing machine has a buttonholer which comprises a releasing cam arrangement which is connectable to the pack and to the followers and which is rotatable by the pack from a starting position through predetermined first angular positions so as to displace the followers from an engaged position riding on respective cams into a disengaged position clear of the cams only when the pack is in the first angular positions. A shifter is provided which is connected to the releasing cam arrangement which displaces the followers axially along the pack each time the releasing means displaces the followers from engaged to disengaged position. A stopper disconnects the releasing cam arrangement from the shifter in a predetermined second position which the pack assumes after passing through the first positions. A clearing device is provided for disconnecting the releasing cam arrangement from the pack and returning it to the stopping position, and a setting arrangement is provided having an adjustment element which allows the operation of the releasing cam arrangement as described above or which in inoperative position prevents displacement of the releasing cam arrangement from the starting position.

18 Claims, 66 Drawing Figures

BUILT IN BUTTONHOLER FOR A SEWING MACHINE

CROSS REFERENCE TO RELATED APPLICATIONS

This is a continuation-in-part of my copending patent application No. 711,078 filed 2 Aug. 1976.

BACKGROUND OF THE INVENTION

This invention relates to a buttonhole stitching device for sewing machine, and more particularly relates to a built-in buttonholer which which a buttonhole is stitched by one manual operation of the device while running the sewing machine after buttonhole stitching is selected. Namely when buttonhole stitching is selected, the sewing machine sews first bartack stitches and the leftside stitches of the buttonhole, and then when a manual operation is carried out, the sewing machine sews the second bartack stitches and the right-side stitches of the buttonhole.

The conventional buttonhole stitching devices are complex in operation and lack in practical utility. That is to say, in a sewing machine with a built-in pattern cam group, if the buttonhole stitching is interrupted when only partly completed and another pattern is selected, desired stitches can not be obtained for the pattern because the automatic stepping function of the button hole device remains operative.

In another example, when the button hole stitching has once been selected, a pattern selecting dial can no more be rotated, and it becomes impossible to select another pattern until one cycle of the button hole is completed. Therefore it becomes impossible to temporarily to stop the button hole stitching to reset the device to the first starting position of the buttonhole.

In another example, dials or buttons are provided for selecting a stitch pattern and a button hole stitch respectively, and the pattern selecting dial is normally located in the same position. Therefore it becomes necessary to select the button hole stitching with both hands.

Furthermore, there are also disadvantages in the pattern selecting devices provided in the conventional superposed cam built-in zig-zag sewing machines. That is, as a first system, two operating dials or buttons are provided, and a follower for releasing button is pushed with one hand's thumbs of one hand and in such a condition a follower for selecting patterns is moved with another hand's thumb to rotate a dial therefor, so-called "two hand control". The releasing button must continue to be pushed (heavily in general), and the selecting dial is often forcibly rotated by error when the follower is not released or not fully released.

For a second system the releasing dial is rotated to set the follower at the releasing position, and in the meantime another dial moves the follower. But handling is complicated and cancelling of the releasing condition of the follower is often forgotten.

A third system is that one dial is pushed or pulled to release the follower and the dial is rotated to select a desired cam while maintaining the releasing condition with the thumbs. Not only is the releasing operation rather difficult, but also the dial can be rotated, when the follower is not fully released, so that the sewing machine is damaged.

A fourth example is that releasing and selecting are carried out per one step only by rotation of one dial. Although operation is simple, the rotating angle of one step of the dial is naturally large since nowaday an automatic feed must release at least two followers of the lateral needle movement and the cloth feed, and if the roating angle is not large, the operation is different, since after the followers are released, they are moved and this releasing condition is cancelled. Therefore in many stored pattern cams, the rotating angle of the dial is considerably large and operation is poor.

As said, the conventional devices are accompanied with many disadvantages and lack in industrial or practical merits.

SUMMARY OF THE INVENTION

The invention has been devised to remove the disadvantages in the prior art. A fundamental object of the invention is to stitch one side bar tuck and/either left or right side line by one setting operation to heighten efficiency.

Another object of the invention is to readily switch from the ordinary pattern stitching to the button hole stitching system, and vice versa.

Another object of the invention is, when stitching the button hole or ordinary pattern to clear the button hole stitching condition and thus avoid undesired stitches by mixing the former stitches.

BRIEF DESCRIPTION OF THE FIGURES

Other features and characteristics of this invention will be apparent from the following explanation of the invention with reference to the attached drawings. Breif explanation of the drawings;

FIG. 3-C is a front elevational view of this invention partly shown in which a spring receiving element presses a first compression spring.

FIG. 3-D is a front elevational view of the spring receiving element shown in a vertical section.

FIG. 12-B is a sectional view of the operating device of this invention showing a condition in which the cam followers are engaged with the pattern cams.

Figure 1:
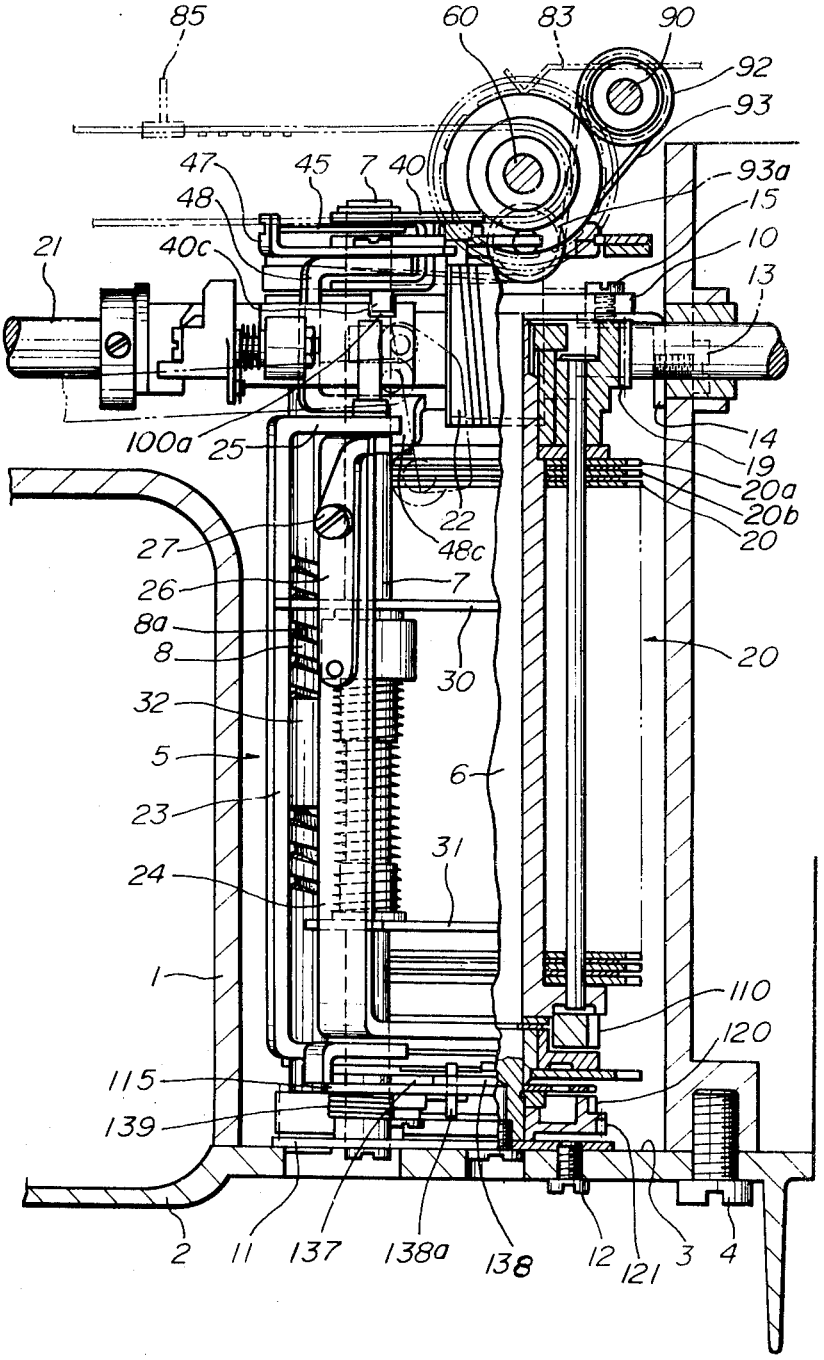
FIG. 1 is a front elevational view of a sewing machine provided with this invention shown partly in a vertical cross section.
Figure 2:
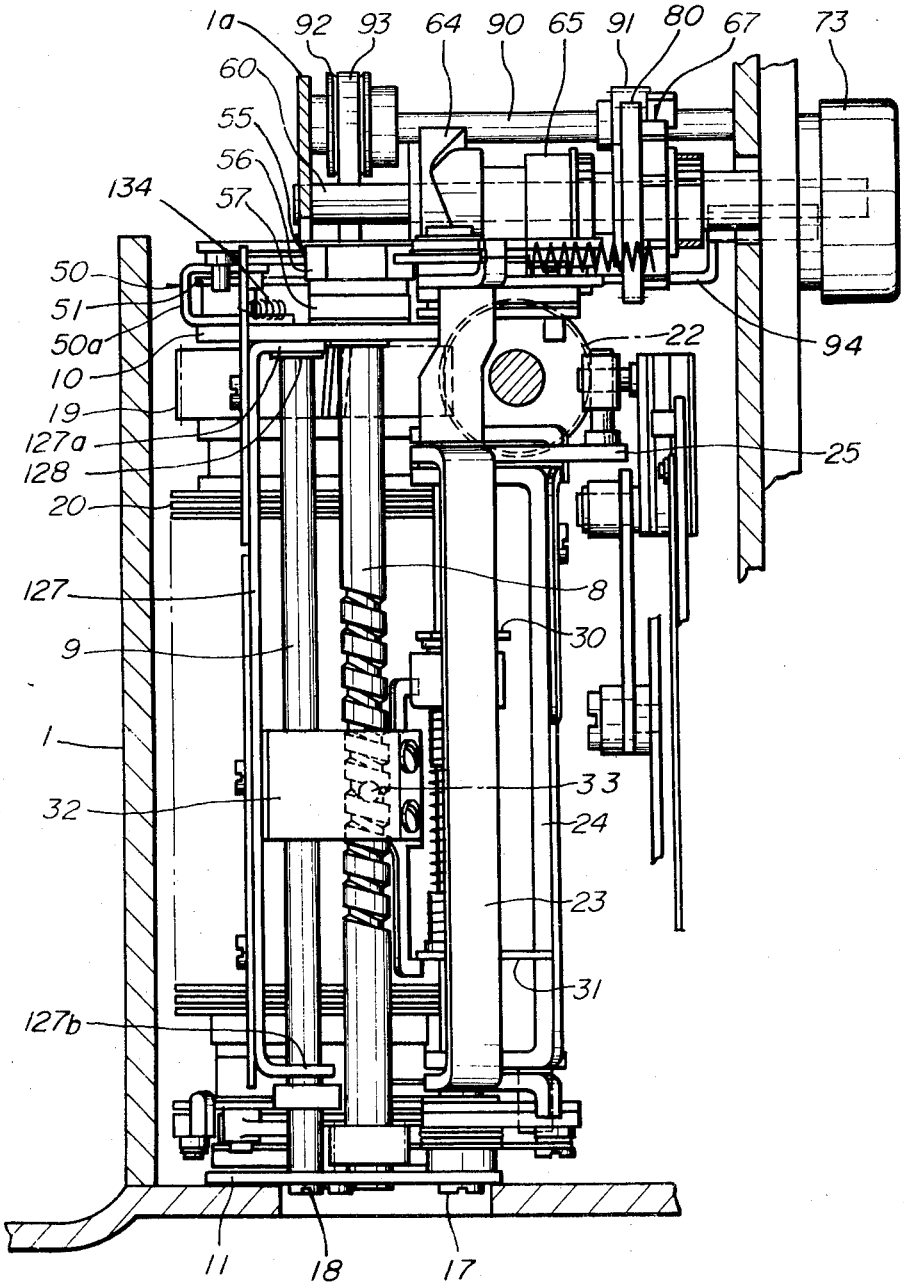
FIG. 2 is a side elevational view of FIG. 1 shown partly in a vertical section.
Figure 6:
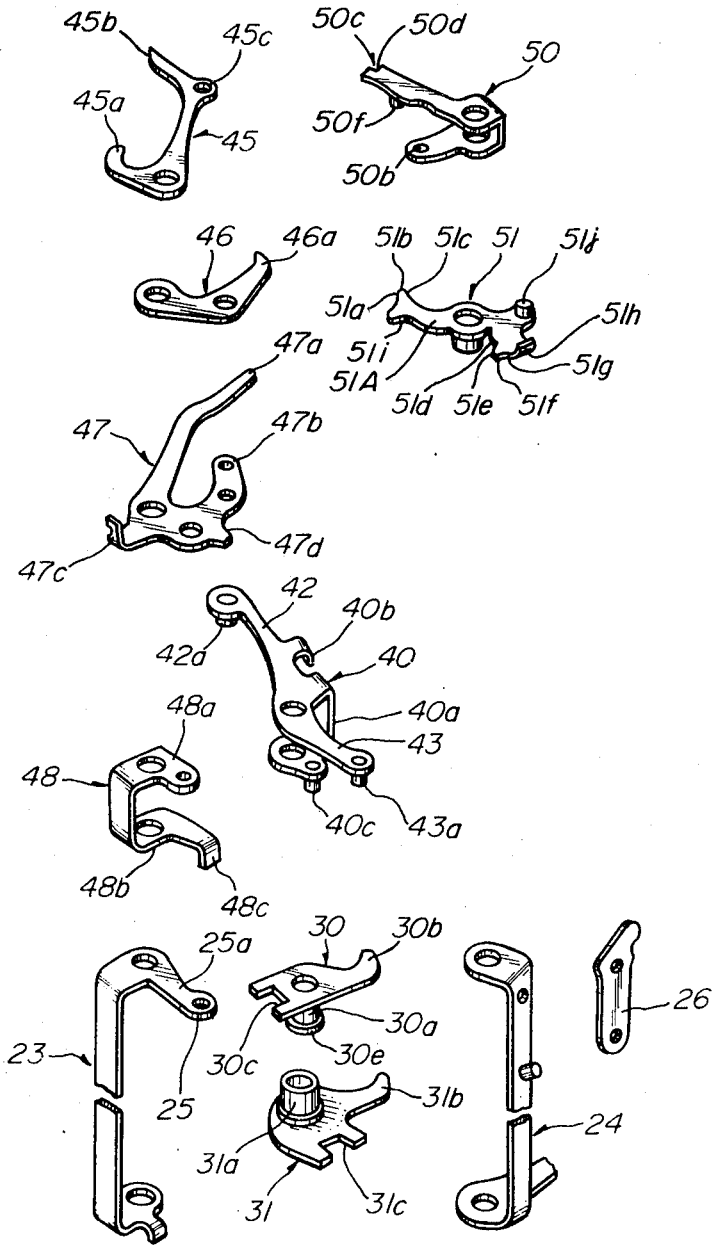
FIG. 6 is an exploded perspective view of a cam selecting device of this invention.
Figure 26:
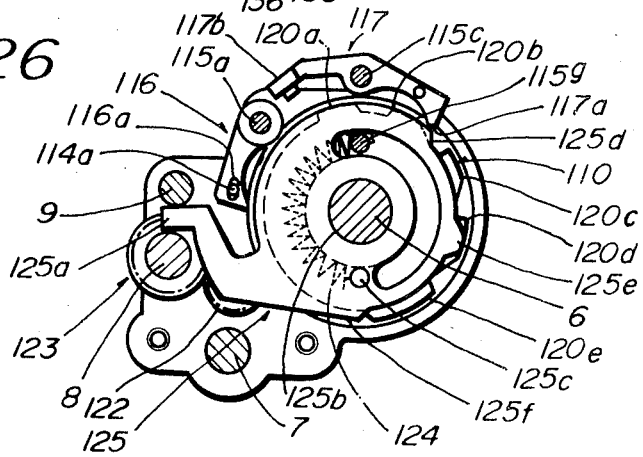
Figure 27:
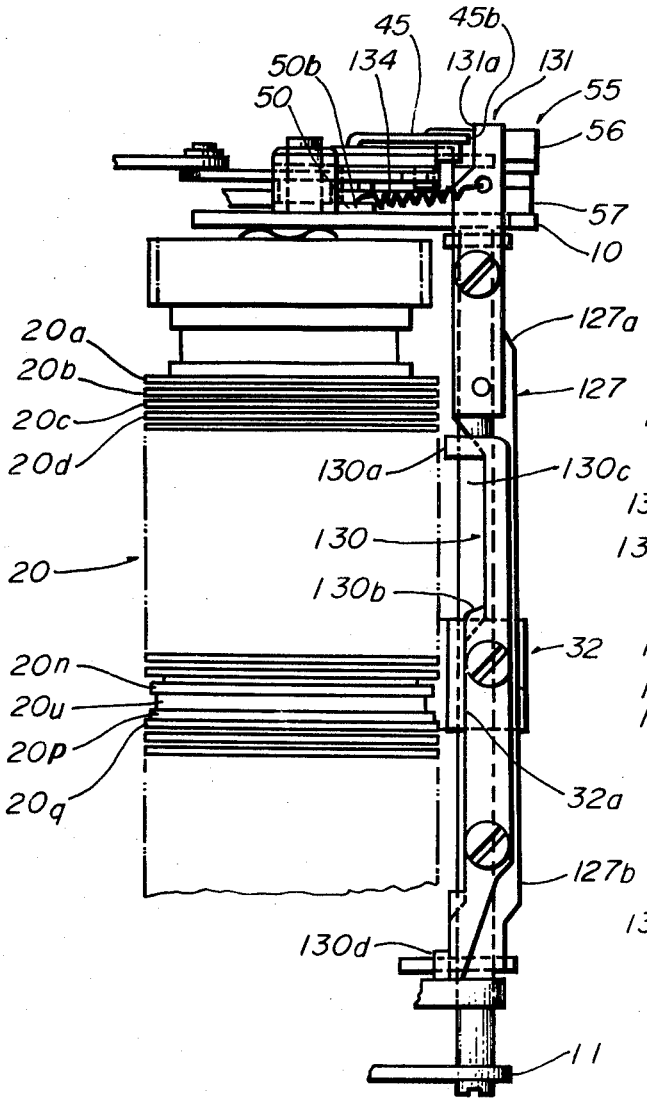
FIGS. 27 to 32 are explanatory views of a button hole stitching cam selecting device of this invention.
Figure 28:
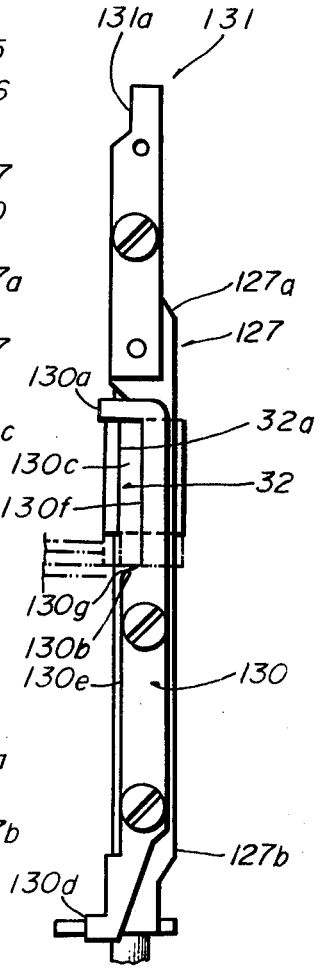

DETAILED EXPLANATION OF THE INVENTION;

Referring to FIGS. 1 and 2, referance numeral 1 is a standard of a sewing machine positioned on the support face 3 of a machine bed 2 and fixed thereto by means of screws 4, one of which is seen. Numeral 5 is a mechanism unit of a cam selecting device and is composed of an upper plate 10, a lower plate 11, and between the two plates, there are arranged a cam shift 6, a follower shaft 7, a feeding screw shaft 8 and guide shaft 9. The mechanism unit 5 is vertically arranged in the standard, and the lower plate 11 is fixed to the support face 3 of the machine bed by means of screws 12, one of which is seen, and the upper plate 10 is secured to a bracket 14 by means of screws 15, one of which is seen. The bracket 14 is fixed to the standard 1 by means of a screw 13. The cam shaft 6 and follower shaft 7 are fixedly supported between the upper and lower plates 10, 11, and the guide shaft 8 is rotatably supported between the two plates. As illustrated in FIGS. 26–28, on the cam shaft 6 is rotatably mounted a unit of a worn wheel 19 and a plurality of packed pattern cams 20 including feed control cams. The unit is prevented from shifting vertically on the cam shaft. The worn wheel 19 engages a worn 22, as illustrated in FIGS. 1 and 2, which is mounted on an upper shaft 21 rotatably supported to the machine arm 1, and is rotated with the upper shaft 21. Thus, the unit of the worm wheel 19 and the packed pattern cams 20 is rotated in a reduced speed in the clockwise direction in reference to FIGS. 26 and 27. As illustrated in FIGS. 1–4 and 54, numerals 23 24 are U-shaped plates which are turnably mounted on the follower shaft 7 and prevented from moving in the axial direction. The U-shaped plate 24 is positioned within the U-shaped plate 23. The plate 23 is in association with a needle control follower 30 and the plate 24 is in association with a feed control follower 31 as illustrated in FIG. 26. The U-shaped plate 23 is formed with a horizontal projection 25 at the top thereof, and the U-shaped plate 24 has an engaging element 26 attached thereto by means of screw 27 at the upper part thereof. The engaging element 26 has a projection 26*a* adjacent the horizontal projection 25 of the U-shaped plate 23 as illustrated in FIG. 1. As illustrated in FIGS. 3-A and 26 the followers 30 31 have bosses 30*a* 31*a* respectively and turnably mounted on the follower shaft 7. These followers 30 31 have pawls 30*b* 31*b* respectively at one end thereof for engaging the pattern cams 20 and feed control cams respectively and have forked ends 30*c* 31*c* respectively at the other end thereof for engaging the vertical parts of the U-shaped plates 23 24 respectively as illustrated in FIGS. 6, 26 and 27. The followers 30 31 are pressed to one of the pattern cams 20 and one of the feed control cams respectively by means of respective springs (not shown).

Figure 3A:
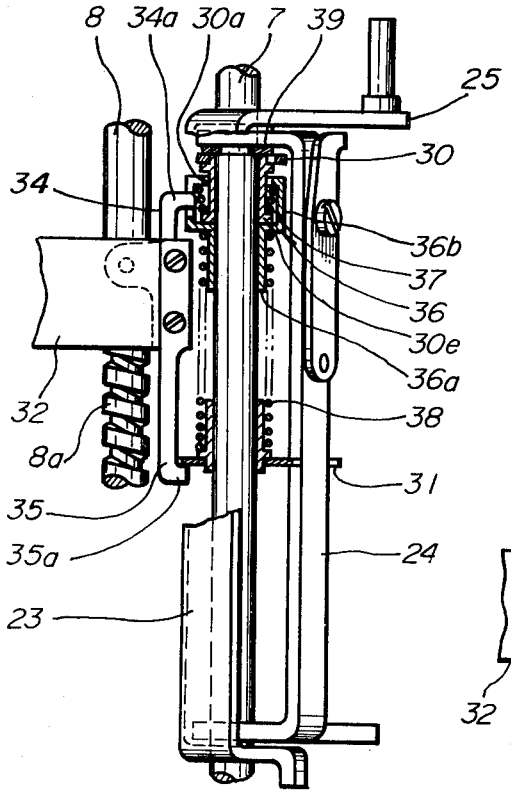
FIG. 3-A is a front elevational view of this invention partly shown in which a moving element is moved to the upper position, FIG. 3-B is the same as FIG. 3-A but the moving element is moved to the lower position.
Figure 3B:
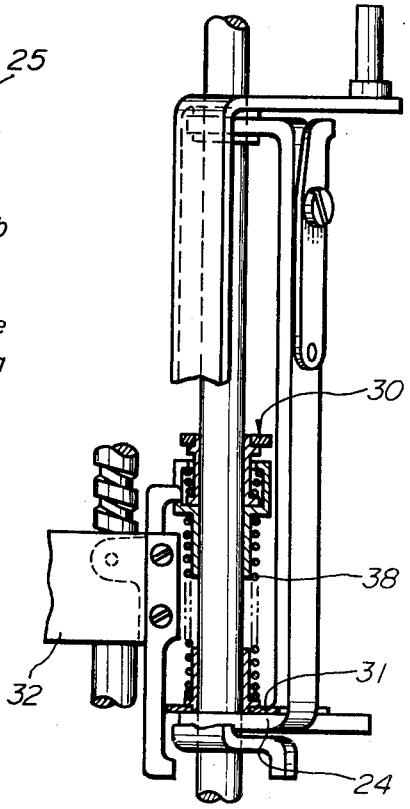
Figure 3C:
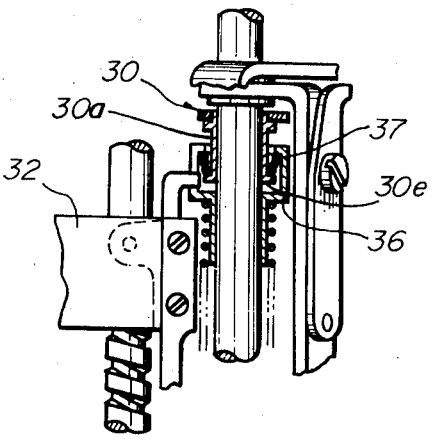
Figure 3D:
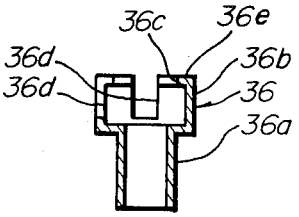

As illustrated in FIGS. 2, 3A–3C and 28, numeral 32 is a moving element slideably mounted at one end thereof on a vertical shaft 9 fixedly arranged between the upper plate 10 and the lower plate 11 in parallel with the guide shaft 8. Since the moving element 32 is equipped with a pin 33 laterally extending on the inner face thereof for engaging a thread groove 8*a* of the guide shaft 8, it is moved in the axial direction in accordance with rotation of the guide shaft 8. The moving element 32 has plates 34 35 attached to the other end thereof. These plates have engaging parts 34*a* 35*a* respectively. A capsule 36 is slidably mounted on the followers shaft 7 between the follower 30 for the pattern cams and the follower 31 for the feed control cams. The capsule has a central boss 36*a* and and enlarged upper cylindrical portion 36*b* with a flange 36*c* around at the top thereof. The cylindrical portion 36*b* is formed with vertical cut-outs 36*d* as illustrated in FIG. 3D, and receives the boss 30*a* of the follower 30 having a lower flange 30*e* as illustrated in FIG. 6.

A compression spring 37 is positioned around the boss 30*a* of the follower 30 and between the flange 36*c* of the capsule 36 and the flange 30*e* of the boss 30*a* of the follower 30. Another compression spring 38 is positioned around the follower shaft 7 and between the capsule 36 and the lower follower 31. The engaging part 34*a* of the plate 34 on the moving element 32 engages one of the vertical cut-outs 36*d* of the capsule 36, and the engaging part 35*a* of the plate 35 is adapted to engage the underside of the lower follower 31 for the feed control cams of the pattern cams 20. Accordingly, when the guide shaft 8 is rotated, the moving element 32 is axially moved and the followers 30 31 are also axially moved via the moving plates 34 35 and the capsule 36. If the moving element 32 is moved upwardly as shown in FIG. 3-A, the follower 30 contacts a stop ring 39 fixedly mounted on the follower shaft 7 at the upper part thereof, and stops there, but the lower follower 31 continues to move a little upwardly against the action of the compression spring 38. FIG. 3–B shows that the moving element 32 moves downwardly, and in this case the lower follower 31 is stopped by contacting the lateral extension of the U-shaped plate 24, but the upper follower 30 continues to move a little downwardly against the action of the compression spring 38. In either case, the first compression spring 37 is not influenced by the second compression spring 38. However when the upper follower 30 is urged to move when it is not completely separated from one of the pattern cams 20 during its downward movement, only the capsule 36 is moved while compressing the first compression spring 37 as shown in FIG. 3-C and the follower 30 does not move but retains there. When the machine is then manually rotated to rotate the cam adjacent the follower 30 and the recessed portion of the cam aligns with the follower, to be shifted by the compression spring 37.

Figure 8:
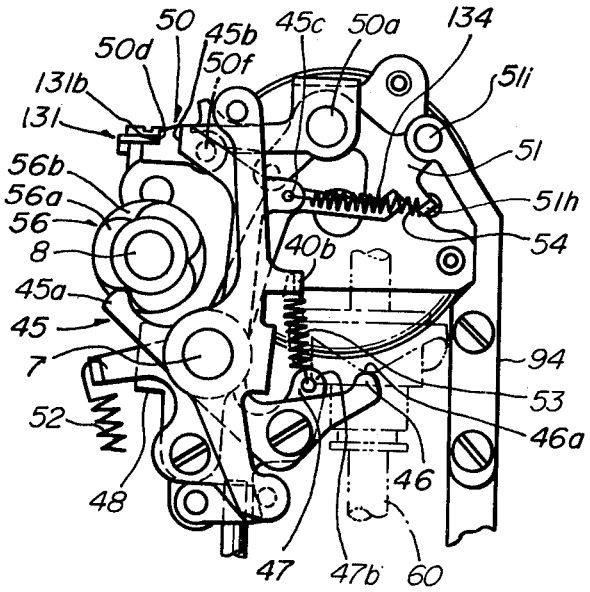
FIGS. 8 to 11 are partial explanatory views of the cam selecting device.
Figure 10:
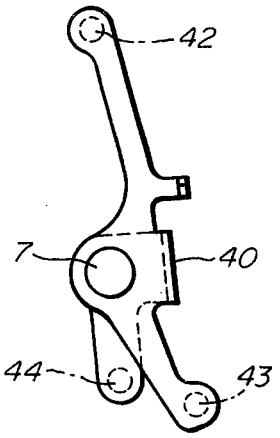
Figure 9:
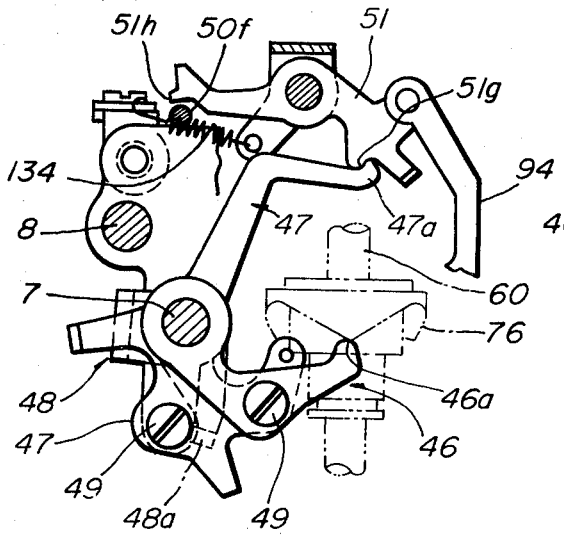
Figure 11:
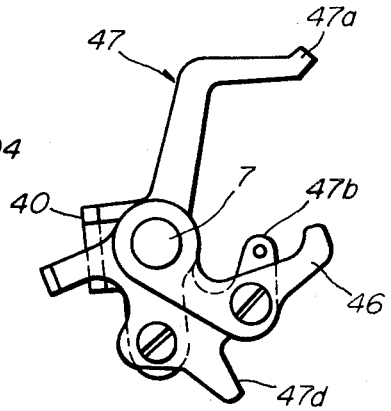

As illustrated in FIGS. 1, 6, 26 and 27, numeral 40 is an actuating lever having arms 42 43, U-shaped arm 40*a* and projection 40*b* on the arm 42 and is turnably mounted on top of the follower shaft 7 passing through the upper base plate 10. Pins 40*c* 42*a* 43*a* are attached to the free ends of the U-shaped arm 40*a*, and of the arms 42 and 43 respectively as shown. Within the U-shaped arm 40*a* of the arm 40 there are turnably mounted on the follower shaft 7 in order from the top a recovering arm 45, a releasing plate 46, a holding lever 47 and a U-shaped releasing arm 48. The recovering arm 45 has a follower 45*a*; the releasing plate 46 has a follower 46*a*; the holding lever 47 has arms 47*a* and 47*b* and projections 47*c* and 47*d*; and the U-shaped releasing arm 48 has a depending projection 48*c* as shown in FIG. 6. As illustrated in FIGS. 8, 9 and 11, the releasing plate 46 is connected to the arm 47*b* of the holding lever 47, and the holding lever is connected to the releasing arm 48 respectively by means of screws 49 and 49, so that the releasing plate 46, the holding lever 47 and the releasing arm 48 may be turnable with each other in a unit.

As illustrated in FIGS. 1 and 27, the U-shaped releasing arm 48 straddles the upper base plate 10, and the upper part 48*a* of the arm 48 is loosely mounted on the extended follower shaft above the base plate 10 and the lower part 48*b* is also loosely mounted on the follower shaft 7 below the base plate 10.

Figure 7:
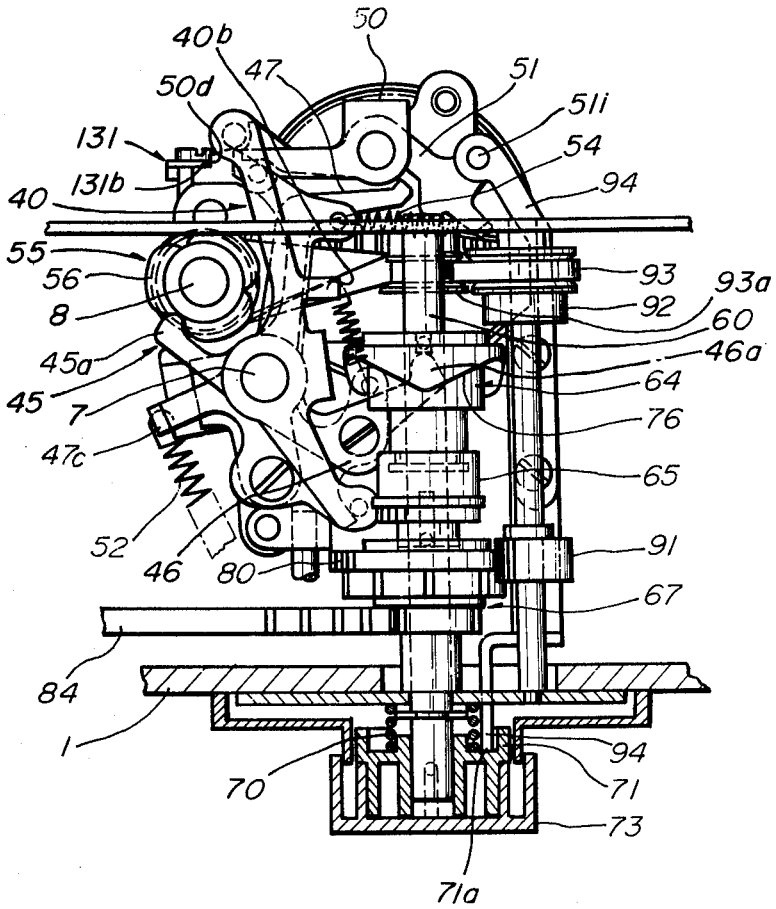
FIG. 7 is a cross sectioned plan view of the upper part of the cam selecting device.

Numeral 50 is a U-shaped member turnably mounted as seen in FIG. 7 on the upper base plate 10 by means of a pin 50*a* at a position remote from the upper extended portion of the follower shaft 7. A holding plate 51 is turnably mounted on the pin 50*a* within the U-shaped member 50, and has engaging portions 51*a* – *51h* and an upper projection 51*j* as illustrated in FIG. 6.

Figure 14:
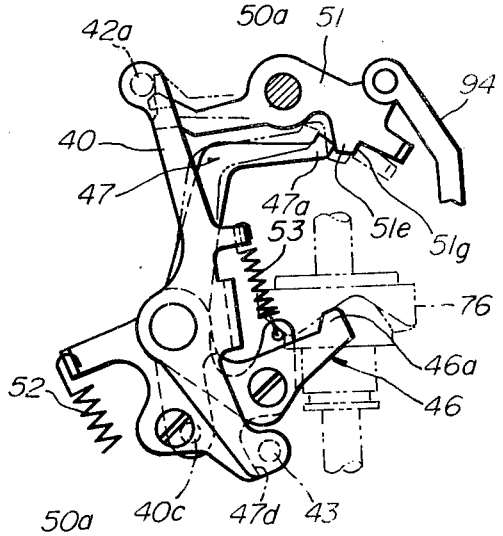
FIG. 14 and 15 are explanatory views of a part of the cam selecting device.

As illustrated in FIGS. 7 and 8, a tension spring 52 is at one end connected to the projection 47*c* of the holding lever 47 and is at the other end anchored to a machine housing 1, so that the unit of the releasing plate 46, holding lever 47 and the releasing arm 48 is pulled in the counter-clockwise direction. A tension spring 53 is at one end connected to the depending projection 40*a* of the actuating lever 40 and at the other end anchored to the arm 47*b* of the holding lever 47 so that the actuating lever is pulled in the clockwise direction. Thus, the pin 43*a* of the actuating lever 40 is pressed against the projection 47*d* of the holding lever 47 as shown in FIGS. 7 8 and 14. Accordingly the actuating lever 40 is together with the unit of releasing plate 46, holding lever 47 and releasing arm 48 pulled in the counterclockwise direction by the tension spring 52. A tension spring 54 is at one end connected to the projection 51*h* of the holding plate 51 and is at the other end connected to the hole 45*c* of the recovering arm 45 so as to pull the recovering arm 45 in the clockwise direction. A sprocket body 55 composed of an indexing cam 56 and a sprocket 57 which are mounted on the top of the guide shaft 8 projected from the upper plate 10 as illustrated in FIG. 27. The indexing cam 56 is engaged by the follower 45*a* of the recovering arm 45 biased by the spring 54.

In FIGS. 7, 12A, 12B and 13, a dial shaft 60 is rotatably mounted across machine frame 1. A disk 62 is mounted on the dial shaft and is prevented from rotation relative to the shaft 62 by means of a pin 61 passingtthrough the shaft and a slot 62*a* in the disk. Adjacent the disk 62, a releasing cam body 64 composed of a cam 76 and a boss 76*a* is mounted on the dial shaft 60 and is axially slidable. A compression spring 63 is mounted around the dial shaft between the disk 62 and the releasing cam body 64. A clutch member 65 is mounted on the dial shaft 60 adjacent the releasing cam body 64. The clutch member 65 is, as shown, axially movable and prevented from rotation relative to the dial shaft 60 by means of a pin 66 fixed on the shaft 60. The clutch member 65 has a pair of ears 65*a* at one end thereof which engage a groove 77 formed around the boss 76*a* of the releasing cam body 64. A rotary member 67 is loosely mounted on/the dial shaft 60 and is prevented from axial movement by means of a stop ring 68 fixed to the shaft 60.

The releasing cam body 64 is formed with radial grooves 75 around the counter-bore thereof to engage the pin 61. On one end part of the dial shaft 60 protruding out of the machine frame 1, a dial member 71 is mounted. The dial member is connected to the dial shaft 60 by means of a pin 72 fixed to the dial shaft, and the dial member is axially shiftable. A compression spring 70 is provided around the dial shaft 60 between the dial member face 71*a* and the machine frame. A dial cover 73 is fitted onto the dial member 71. The dial member 71 is formed with axial projections 71*b* and recesses 71*c* which cooperate with an axial projection 97 fixed to the machine frame 1, so that the dial member may be prevented from axial movement at indefinite angular positions even if it is pushed. The cam 76 of the releasing cam body 64 is engaged by the follower 46*a* of the releasing plate 46 biased by the tension spring 52. The rotary body 67 is formed with radial grooves 79 around the counter-bore thereof to receive radial projections 78 of the clutch member 65. The grooves 79 of the rotary body 67 are aligned with the grooves 75 of the releasing cam body 64. The rotary body 67 is formed with a gear 80. An indexing cam and a sprocket 82 therearound.

In FIG. 1, a leaf spring 83 is at one end fixed to the machine frame 1 and is at the free end thereof engaged with the indexing cam 81 of the rotary member 67.

Figure 48:
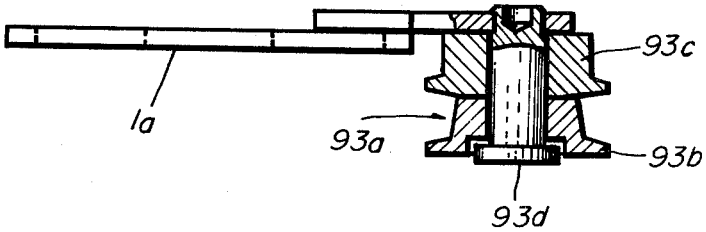
FIG. 48 is a partly sectional plan view of a belt guiding device of this invention.
Figure 49A:
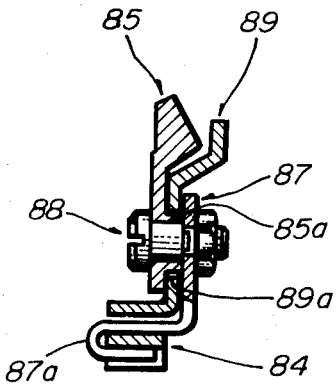
FIGS. 49A to 51 are explanatory views of a button hole stitching selection indicator device of this invention.
Figure 49B:
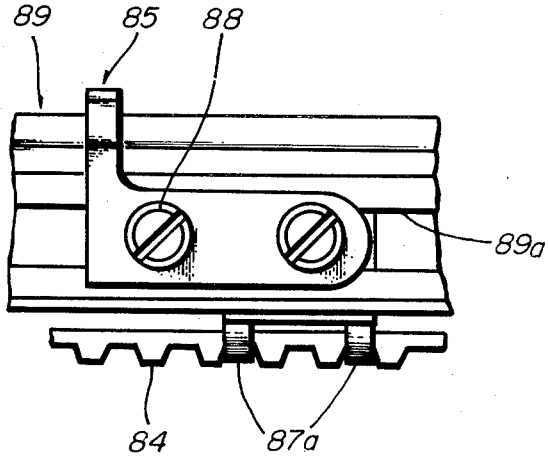
Figure 50:
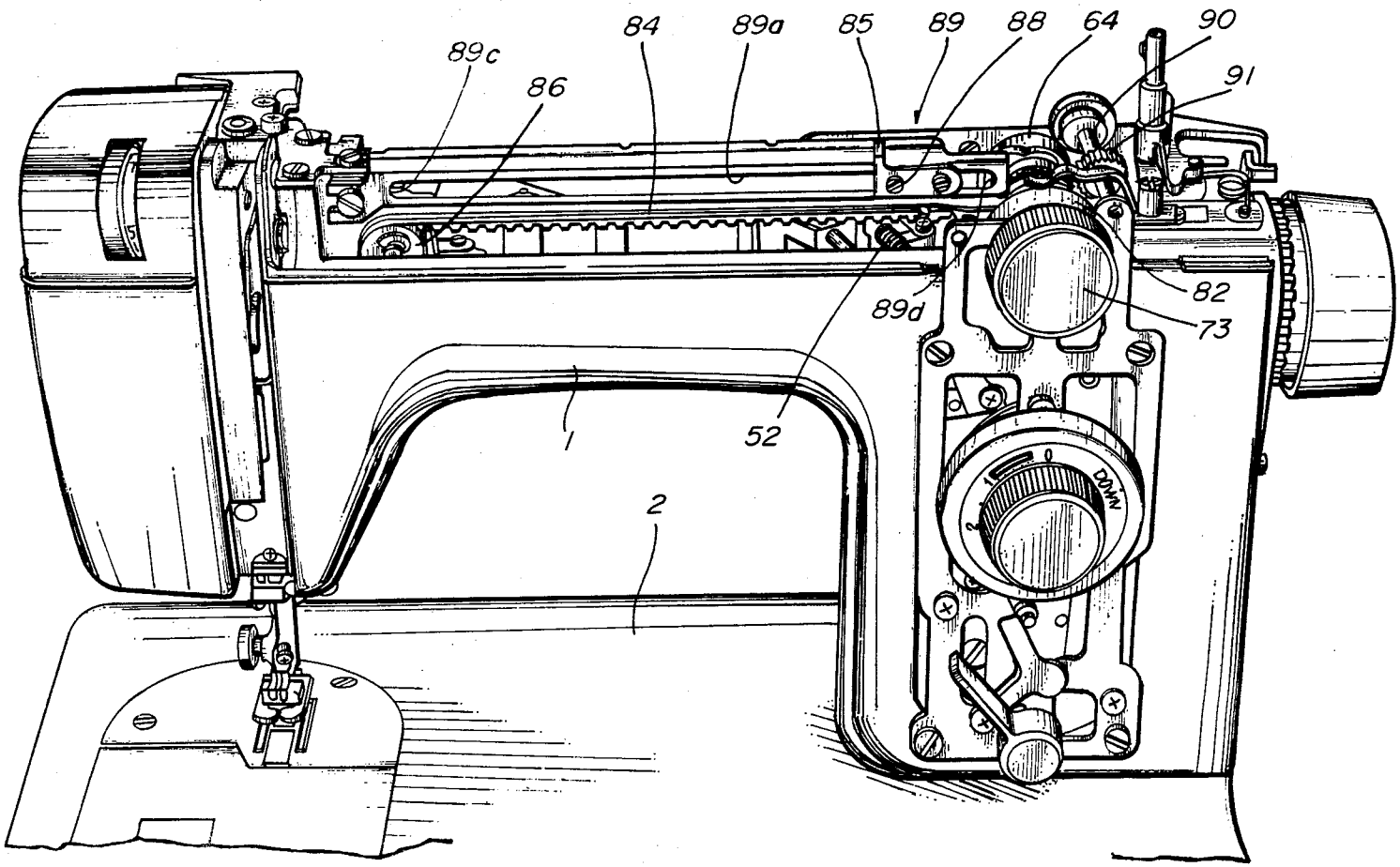
Figure 51:
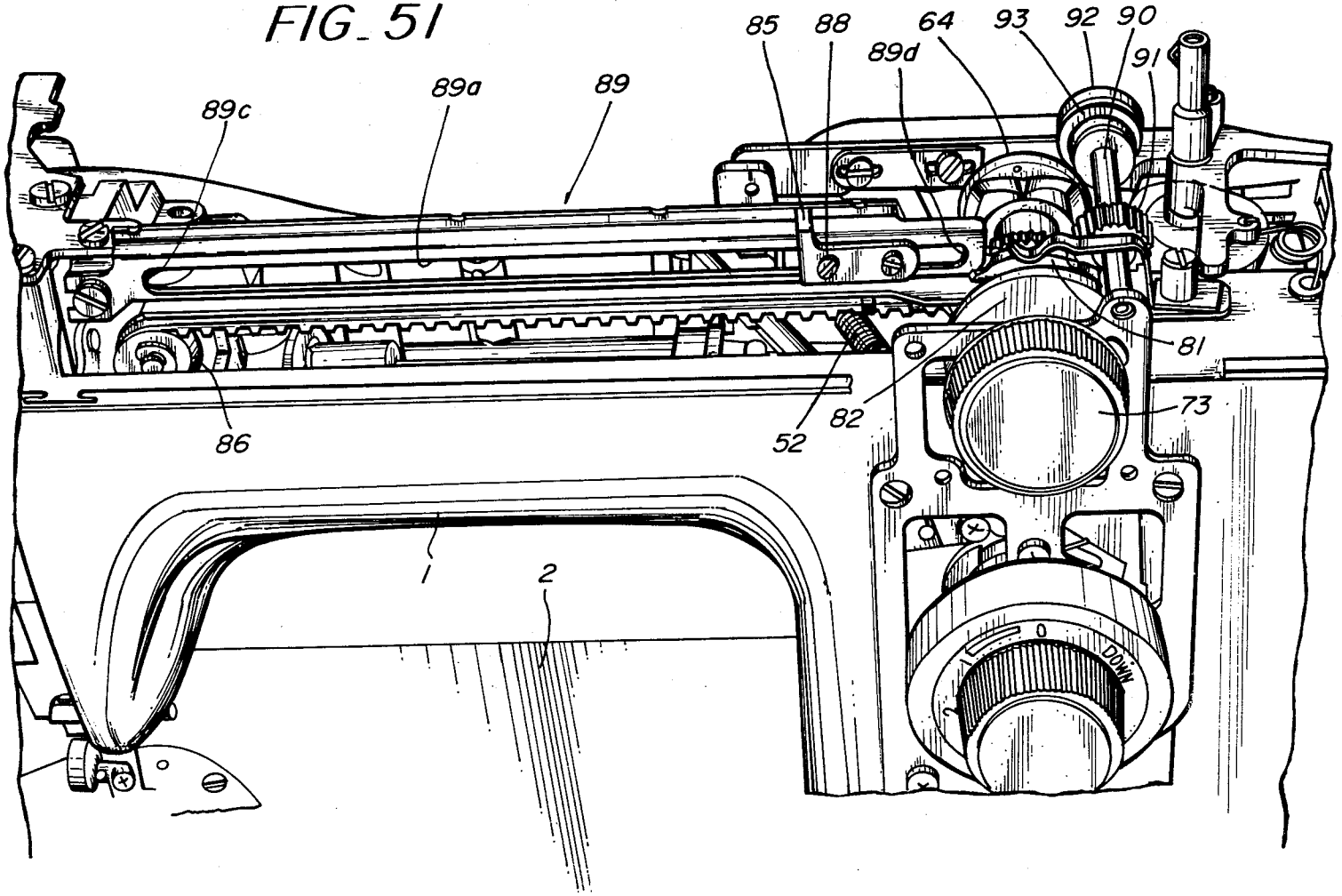
Figure 52:
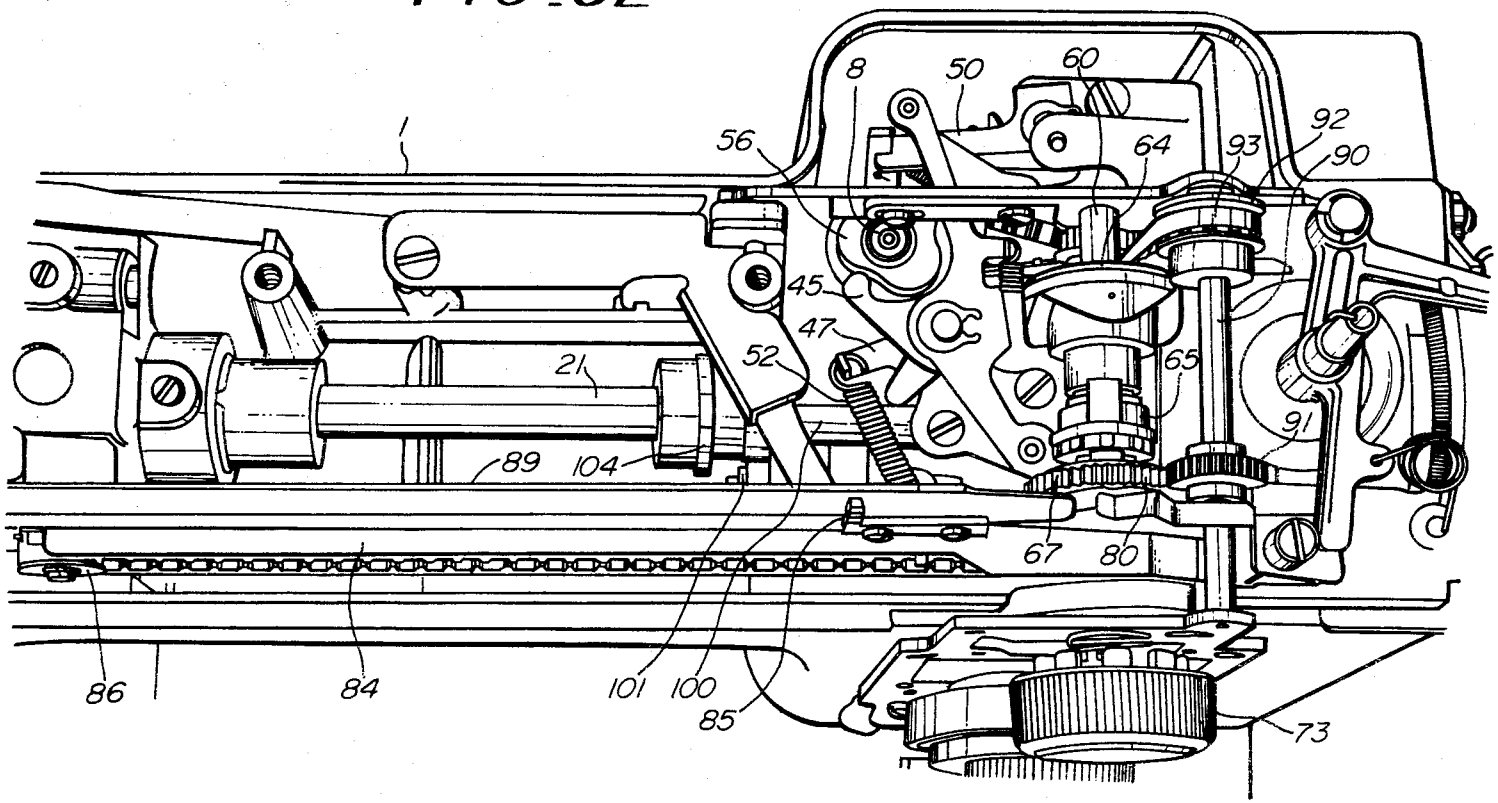
FIGS. 52 and 53 are perspective views of the transmission device of this invention.
Figure 53:
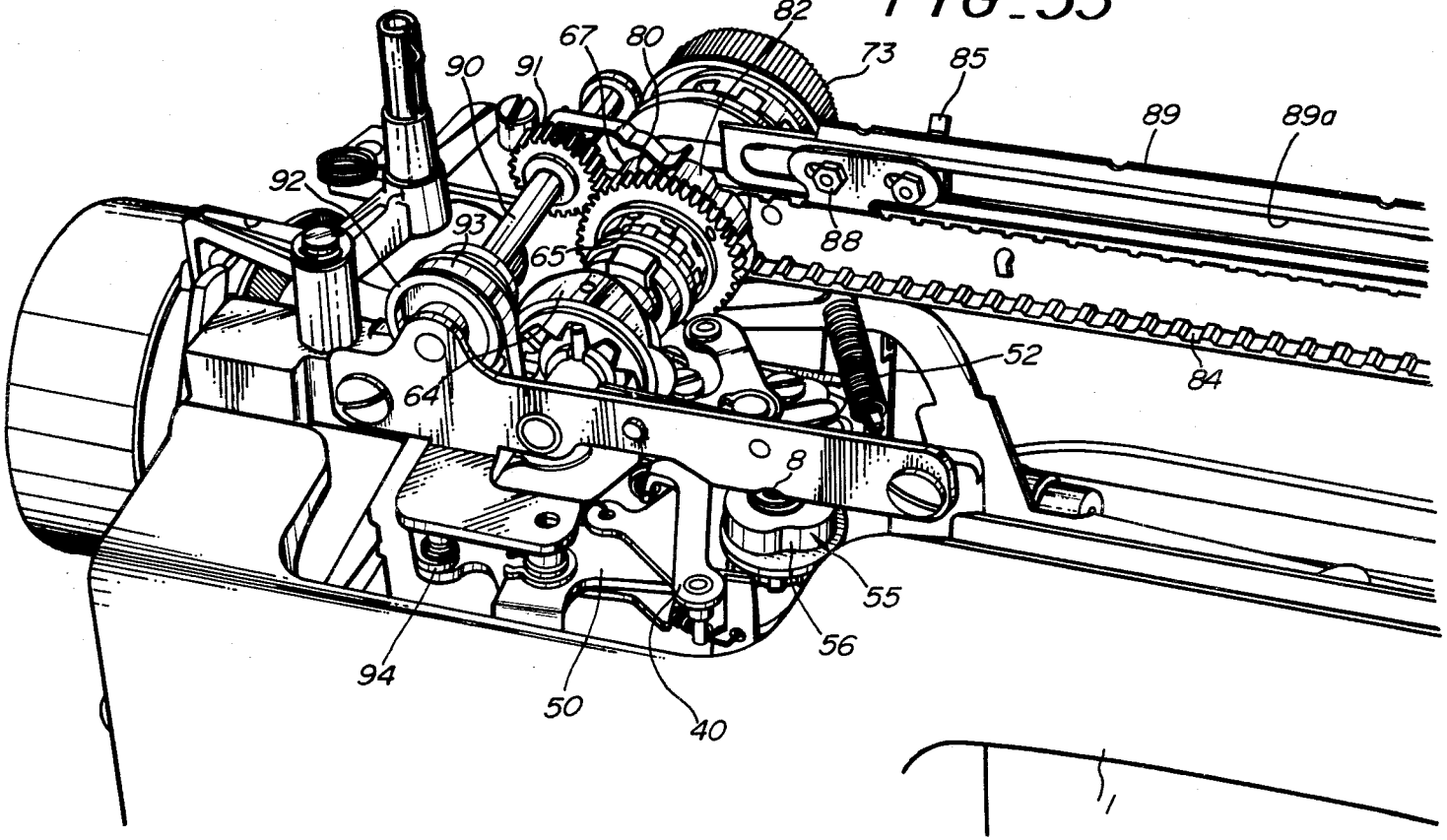
Figure 54:
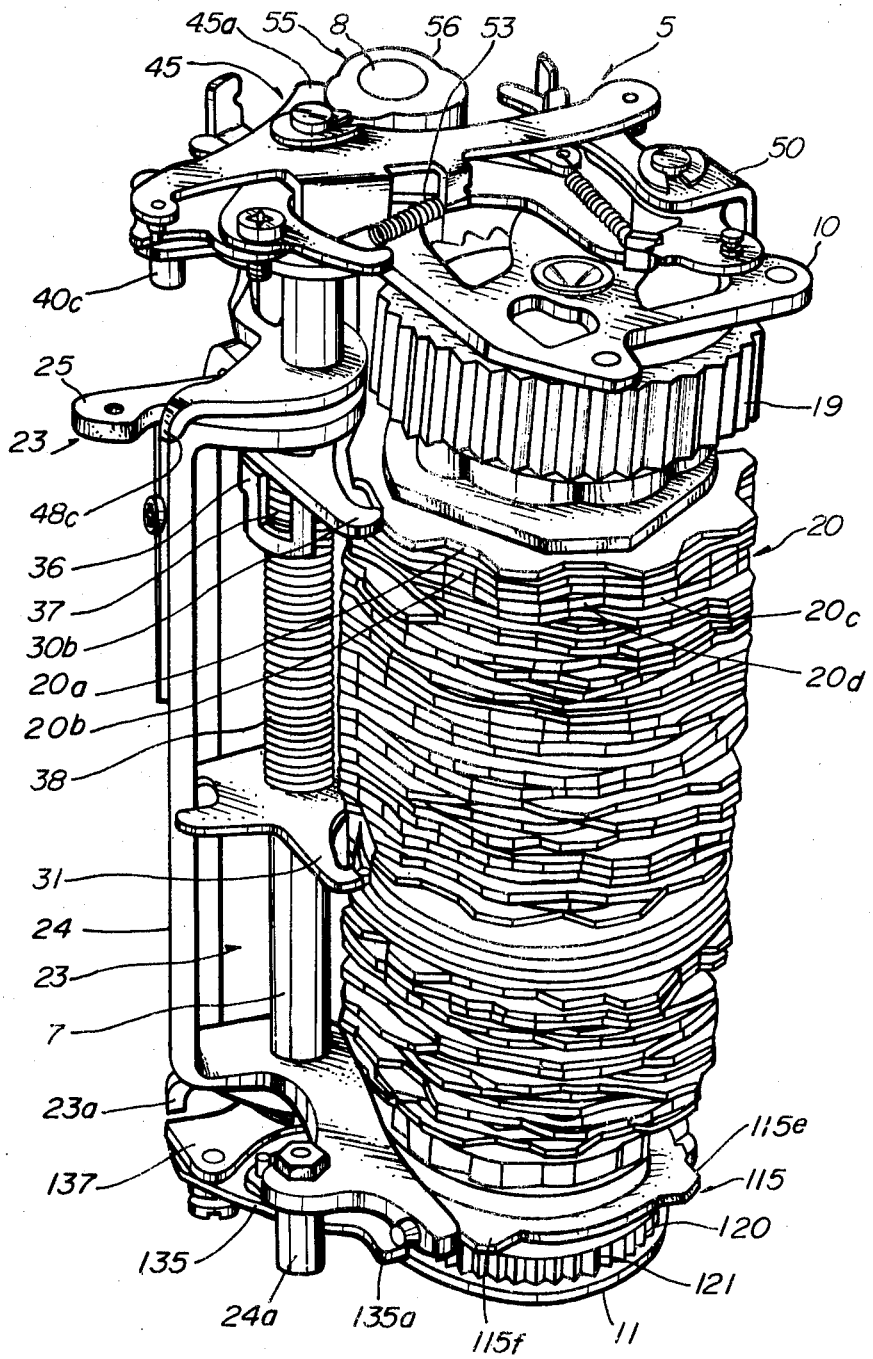
FIGS. 54 to 57C are various views of the button hole stitching device shown in assembled and exploded conditions.
Figure 55:
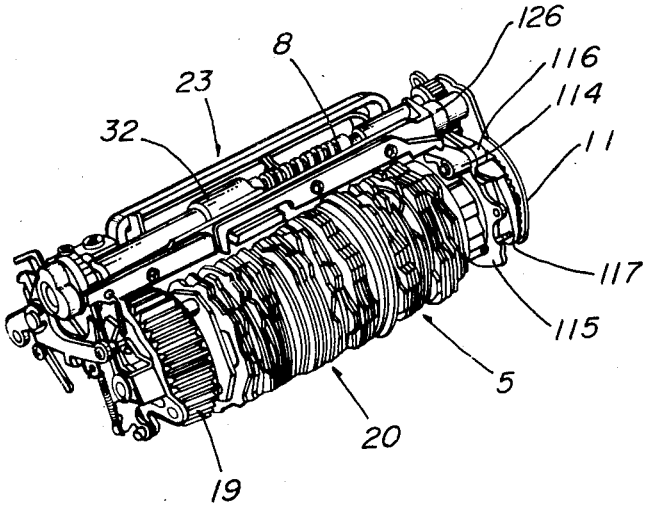
Figure 55:
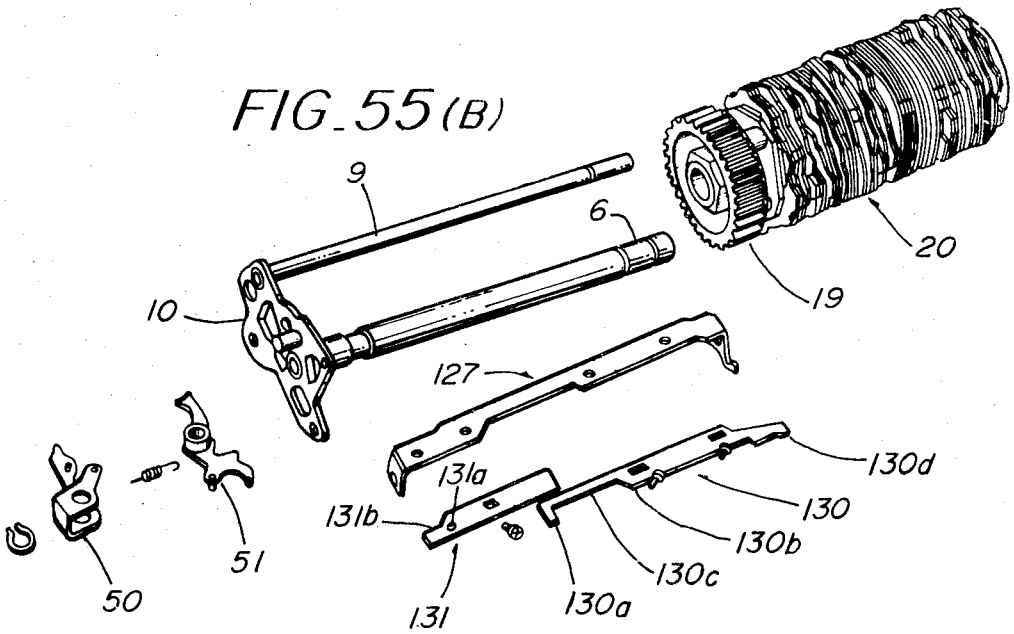

A belt 84 is wound around the sprocket 82 of the rotary member 67 and a pattern indicator 85 is secured on the belt 84. In FIGS. 2 and 7, a transmission shaft 90 is rotatably mounted between the machine frame 1 and a bracket 1*a* fixed the machine frame adjacent to the dial shaft 60, and a small gear 91 is fixed on tthe shaft 90 at the forward part thereof. The small gear 91, engages the gear 80 on the dial shaft 60. A sprocket 92 is secured on the shaft 90 at the rear part thereof. A belt 93 is wound around the gear 92 and aound the sprocket 57 of the sprocket body 55 through an intermediate guide member 93*a* turnably mounted on the machine frame 1. The guide member 93*a* is, as shown in FIG. 48, composed of a roller 93*b* and a gear 93*c* each rotatably mounted on a pin 93*d* fixed to the bracket 1*a*. The belt 93 engages the roller at the flat rear side thereof on the way to the sprocket 57 from the sprocket 92, and also engages the gear 93*c* at the inner toothed side thereof on the way to the sprocket 92 from the sprocket 57. A connecting rod 94 is at one end in contact with the inner face 71*a* of the dial member 71 and is at the other end connected to the projection 51*j* of the holding plate 51. The rod 94 is at one end thereof pressed against the inner face of the dial member 71 by means of the tension spring 54.

The releasing action of the followers 30 31 will be explained with reference to FIGS. 1, 2, 12, 14, 15 and 26. FIGS. 12B and 26 show a condition in which the followers 30 31 are pressed against the corresponding cams of the packed cams 20. When the dial 73 is rotated in the clockwise or counter-clockwise direction, the releasing cam body 64 is rotated accordingly, and the unit of the releasing plate 46, holding lever 47 and the releasing arm 48 is rotated in the clockwise direction around the follower shaft 7 against the action of the tension spring 52, and the projection 48*a* of the releasing arm 48 turns the lateral extension 25 of the U-shaped plate 23 and the projection 26*a* of the engaging element 26 on the U-shaped plate 24 see FIGS. 4 and 6 in the clockwise direction against the action of respective springs (not shown) and disengage the follower 30 and 31 from the respective cams. In the meantime, the arm 47*a* of the holding lever 47 which acts on the engaging portion 51*e* of the holding plate 51 on turning of this holding plate 51 around the pin 50*a* in the counter-clockwise direction, moves along the engaging portion 51*f*. In this position the follower 46*a* of the releasing plate 46 engages the highest point of the cam 76 of the releasing cam body 64 - see FIG. 9. Further rotation of the dial 73 causes the follower 41*a* of the releasing plate 46 to pass the high point of the cam 76.

When the follower 46*a* comes to the lowest portion of the cam 76, the arm 47*a* of the holding lever 47 engages the engaging portion 51*g* of the holding plate 51 by the action of the tension spring 52. Thus, the follower 30 and the follower 31 are held in the positions respectively spaced from the cams 20.

Figure 12A:
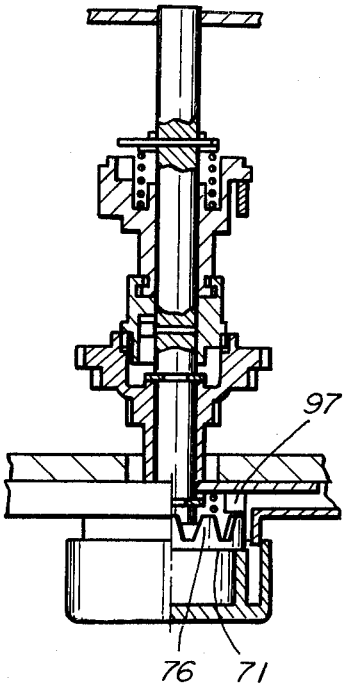
FIG. 12-A is a cross sectional view of an operating device of this invention showing a condition in which the cam followers are spaced from the pattern cams.
Figure 12B:
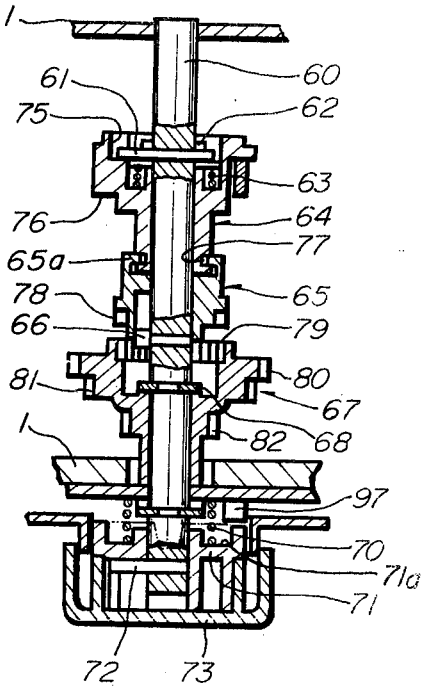
Figure 13:
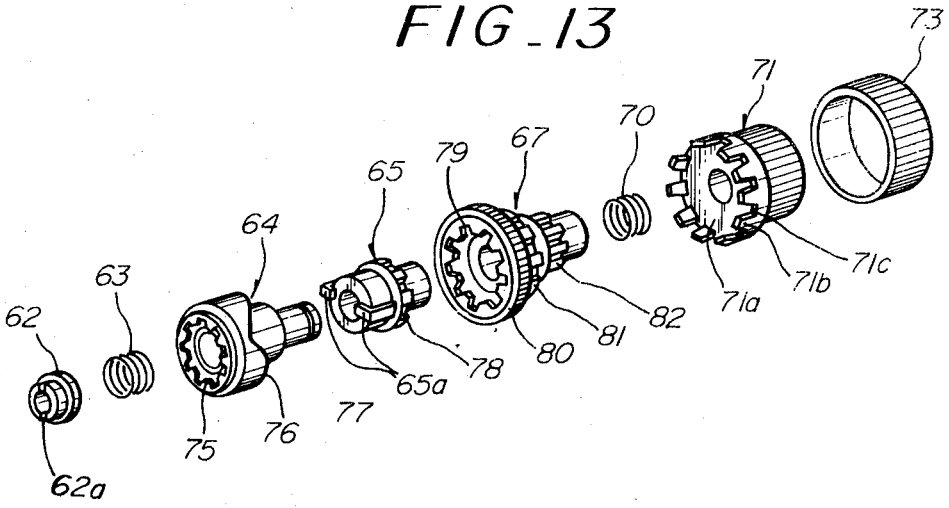
FIG. 13 is an exploded perspective view of an operating part of the operating device.

When the follower 46*a* of the releasing plate 46 engages the lowest portion of the cam 76 and therefore ceases to bear on the cam 76 in a direction away from the dial 73, the releasing cam body 64 is axially moved toward the dial 73 together with the clutch member 65 by means of the compression spring 63, and it is spaced from the pin 61 on the dial shaft 60 as shown in FIG. 12A. Therefore, no rotating movement of the dial shaft 60 is not transmitted to the releasing cam body 64. Simultaneously, the projections 78 of the clutch member 65 engages the radial grooves 79 of the rotary body 67 which is under the influence of the leaf spring 83 in FIG. 1. Accordingly when the dial 71 is rotated the rotary body 67 is rotated via the clutch member 65, and therefore the pattern indicator 85 on the belt 84 is shifted. The rotation of the rotary body 67 causes the guide shaft 8 to rotate via the gear 80, small gear 91, belt 93 and sprockets 92 57 and to shift the follower 30 and the follower 31 along the follower shaft 7 for selecting desired cams.

The manual operation for engaging the followers 30 31 with the selected cams will be explained with reference to FIGS. 7, 8, 12, 14, and 15. If the dial 73 is pushed against the compression spring 70, the holding plate 51 is turned in the counter-clockwise direction through the intermediate rod 94 against the action of tension spring 54. Then the unit of releasing plate 46, the holding lever 47 and releasing arm 48 is turned in the counter-clockwise direction by the action of the tension spring 52. Therefore the arm 47*a* of the holding lever 47 moves along the engaging portions 51*g* - *51f* of the holding plate 51 as shown in dot-dash lines in FIG. 15, and the arm 47*a* engages the engaging portion 51*e* of the holding plate 51 again as illustrated in solid lines in FIG. 14, Since the projection 48*c* of the releasing arm 48 is thus turned in the counter-clockwise direction in FIG. 26, the U-shaped plates 23 24 are allowed to turn in the counter-clockwise direction by the action of the respective springs (not shown) acting on the U-shaped plates 23 24. Thus the follower 30 and the follower 31 are engaged to the selected cams 20. At the same time, the releasing cam body 64 and the clutch member 65 are returned to the position as shown in FIG. 12B against the action of the compression spring 63 by the follower 46*a* of the releasing plate 46 which is under the influence of the tension spring 52 which is stronger than the action of the compression spring 63. It is to be noted that the indexing cam 81 of the rotary body 67 has the same number of divisions with that of the radial grooves 75 of the releasing cam body 64.

The dividing phases of the indexing cam 81 of the rotary body 67 meet those of the grooves 71*c* of the dial member 71. In other positions than those of alignment between the indexing cam 81 of the rotary body 67, and the teeth 71*b* one of the projections 71*b* of the dial member 71 is blocked by the pin 97 when the dial is pushed.

Automatic recovering of the followers 30 31 from the position in which the followers are spaced from the cams 20 to the position in which the followers engage the selected cams will now be explained.

Figure 16:
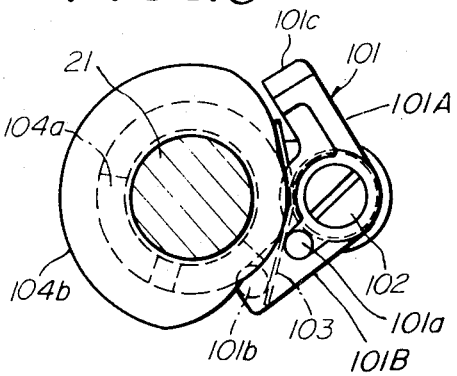
FIGS. 16 to 22 are explanatory views of an automatic recovering device of this invention.
Figure 17:
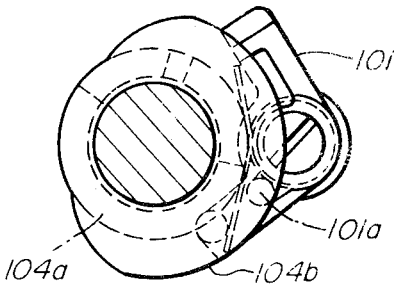
Figure 18:
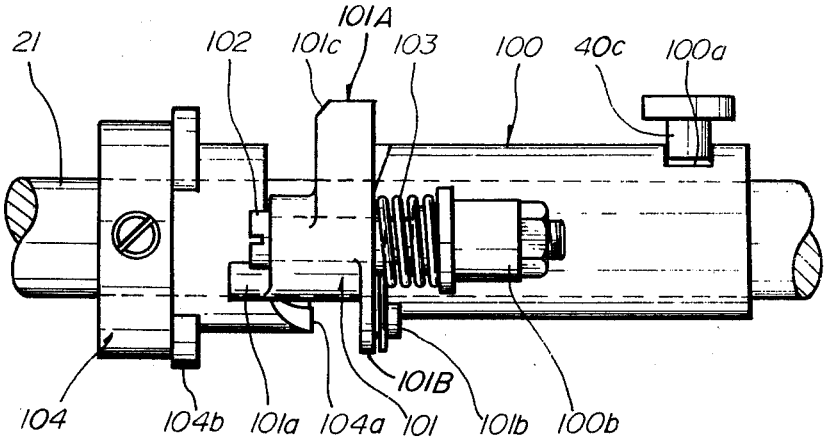

In FIGS. 16–23, an actuating body 100 is mounted on the upper shaft 21 of the sewing machine, and is movable only in the axial direction. The actuating body is provided with a groove 100*a* on the right side part thereof as shown in FIG. 18. The groove is engaged by the depending pin 40*c* of the actuating lever 40 as illustrated in FIGS. 6 and 26. A pawl member 101 having a central boss 101D an upper arm 101A and a lower arm 101B is turnably mounted on a shaft 102 secured to the boss 100B of the actuating body 100. The upper arm 101A has an engaging face 101C on one side and an engaging face 101*c* on the other side thereof. The central boss 101D has a lateral projection 101*a* on one side thereof as illustrated, and the lower arm 101B has a lateral projection 101*b* on the side opposite the lateral projection 101*a* of the boss 101D. A torsion spring 103 is mounted around the shaft 102, and contacts the actuating body 100 at one end thereof and engages the lateral projection 101*b* of the pawl member 101 at the other end thereof. Thus the pawl member 101 is biased in the clockwise direction in FIGS. 16 and 17 in such a manner that the lateral projection 101*a* rides on a cylinder 104C of cam member 104 which is described hereinafter.

Figure 15:
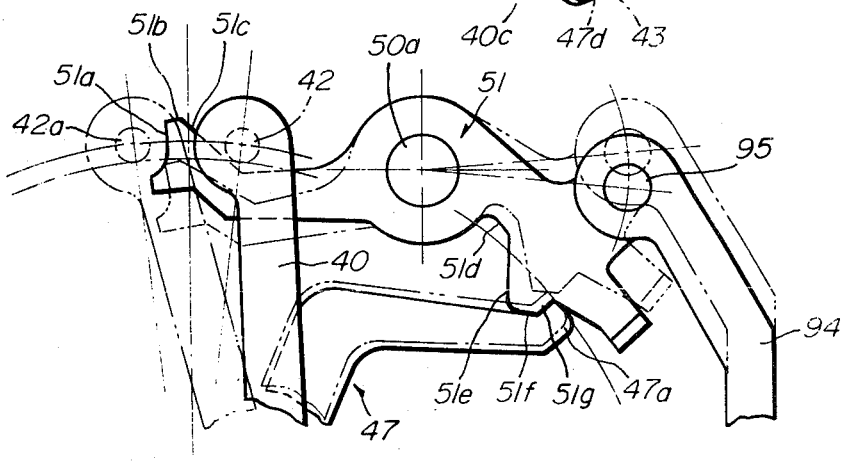
Figure 19:
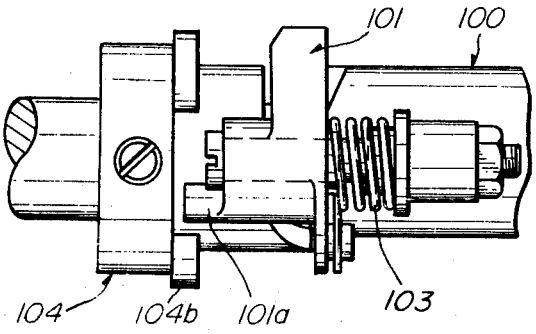
Figure 20:
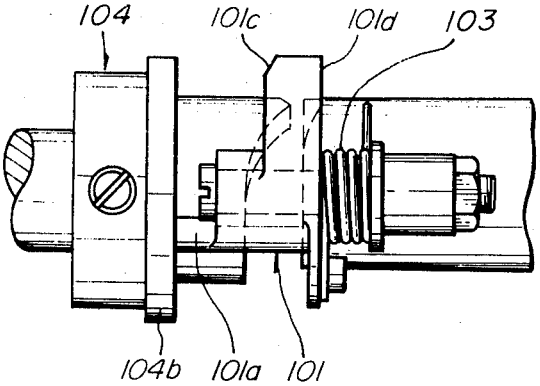
Figure 21:
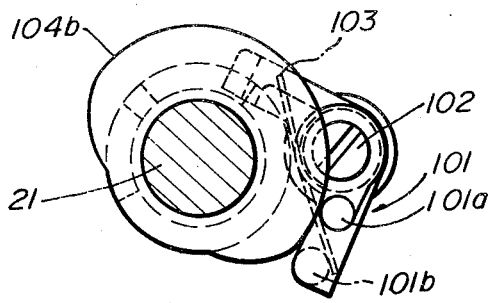
Figure 22:
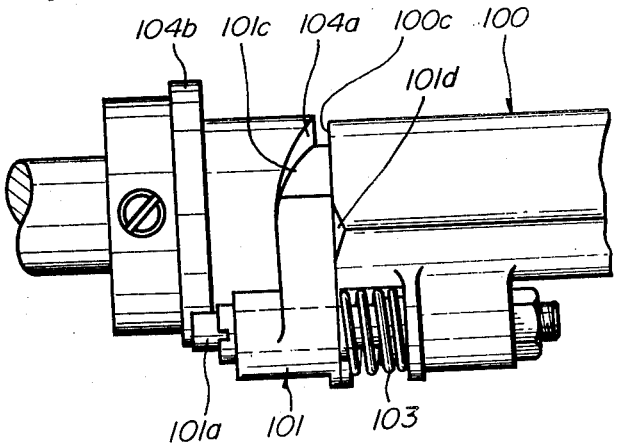
Figure 23:
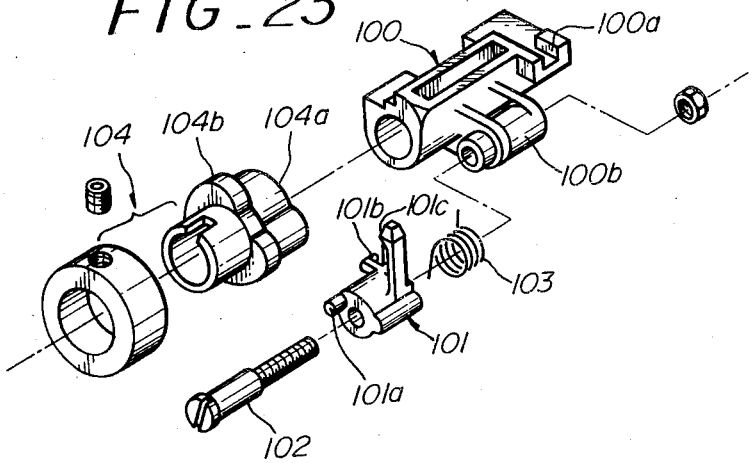
FIG. 23 is broken perspective view of the automatic recovering device.

A cam member 104 is fixedly mounted on the upper shaft 21 of the sewing machine. The cam member 104 is adapted to cooperate with the pawl member 101 and has cam face 104*b* and a cylinder 104C having a cam face 104*a*. When the followers 30 31 engage the cams 20, the actuating body 100 is in a position most remote from the cam member 104, and the arm 101B of the actuating pawl 101 is spaced from the side cam 104*a* of the actuating cam 104 and the lateral projection 101*a* is spaced from the cam 104*b* as shown in FIG. 18. In this instance, the dial 73 and the associated parts are in the condition as shown in FIG. 12-B. If the dial 73 is rotated, the releasing cam body 64 turns the unit of the releasing plate 46, releasing arm 48, holding arm 47 and actuating arm 40, and as a result the followers 30 31 are held in the respective positions spaced from the cams 20 in the manner described above. In the meantime, as the holding plate 51 is turned in the counter-clockwise direction by the tension spring 54 as shown in FIGS. 14 and 26, the pin 42*a* of the actuating lever 40, which has been in engagement with the engaging part 51*a* of the holding plate 51, is disengaged from the engaging part 51*a*, and then the actuating lever 40 is turned in the clockwise direction by means of the tension spring 53 until its pin 43*a* engages the engaging part 47*d* of the holding lever 47 as illustrated in FIGS. 14 and 15. The pin 40*c* of the actuating arm 40 is fitted in the groove 100*a* of the actuating body 100, and therefore when the actuating arm 40 is rotated in the clockwise direction, the actuating body 100 is moved in the axial direction toward the actuating cam 104. When the outer cam 104*b* of the actuating cam 104 is positioned, for example, as shown in FIGS. 16 and 18 so that the lowest part of the cam 104*b* is in the axial shifting path of the projection 101*a*, the pawl member 101 on the actuating body 100 is moved in full stroke, and the lateral projection 101*a* is moved into the rotation path to engage the cam 104*b* as shown in FIG. 19. When the cam 101*b* is positioned as shown in FIG. 17 in which the higher part of the cam 101*b* is positioned in the axial shifting path of the projection 101*a*, axial shifting of the projection 101*a*, and according of the actuating body 100 is blocked in half way by the side of the cam 101*b* against the action of the spring 103 as shown in FIG. 20 until the lowest part of the cam 101*b* comes into axial alignment with the projection 101*a* as the upper shaft 21 of the sewing machine is rotated as shown in FIG. 19. When the upper shaft 21 of the sewing machine is driven in such a condition in the clockwise direction in FIG. 21, the cam 104*b* engages the projection 101*a* of the pawl member 101 as shown in FIG. 22 and turns the pawl member 101 in the counter-clockwise direction against the spring 103 in FIG. 21. Thus the upper arm 101A of the pawl member 101 is positioned between the cylinder cam 104*a* and the actuating body 100 as shown in FIGS. 21 and 22. As the upper shaft 21 further rotates, then the cylinder cam 104*a* engages the engaging part 101*c* of the pawl member 101 and shifts the pawl member 101 and accordingly the actuating body 100 to the right.

Thus, the actuating body 100 is moved to the right to rotate the actuating arm 40 in the counterclockwise direction in FIG. 15 and accordingly the pin 42*a* of the actuating lever 40 turns the holding plate 51 in the counter-clockwise direction around the pin 50*a* as the pin 42*a* engages the engaging part 51*c* of the holding plate 51. In the meantime, the unit of the releasing plate 46, the holding lever 47 and the releasing arm 48 are turned in the counterclockwise direction by the tension spring 52. Therefore, the arm 47*a* of the holding lever 47 is moved along the engaging parts 51*g* 51*f* 51*e* and to the engaging part 51*d* of the holding plate 51 as shown in the imaginary lines in FIGS. 14 and 15. In the meantime, the dependent projection 48*c* of the releasing arm 48 in FIGS. 6, 26 and 27 is moved to allow the U-shaped plates 23 24 to turn in the counterclockwise direction. Thus, the followers 30 31 are released to engage the selected cams. In the meantime the follower 46*a* of the releasing plate 46 pushes the cam 76 of the cam body 64 in FIG. 14. Thus, the dial mechanism in the condition of FIG. 12A is returned to the condition in FIG. 12B.

Figure 24:
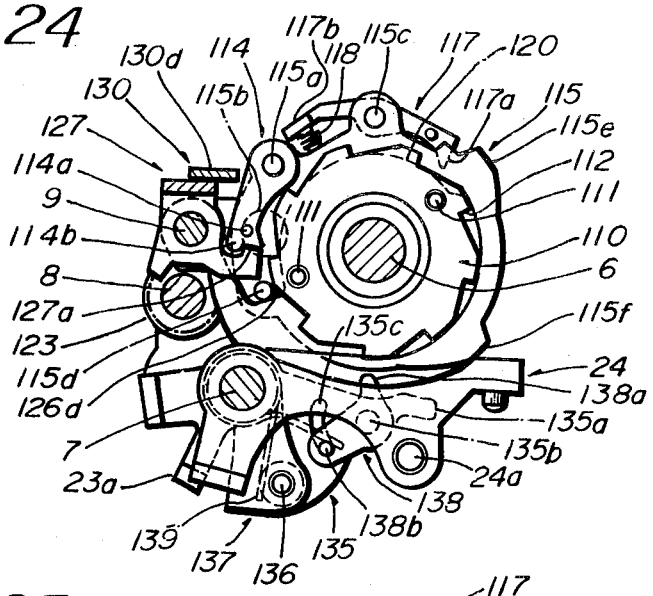
FIGS. 24 to 26 are explanatory plan views of a button hole stitching device of this invention.

Now, the button hole stitching device will be discussed. In FIG. 24, a pawl wheel 110 is mounted on the cam shaft 6 and is fixed to the group 20 of the pattern cams with screws 111, and the number of engaging parts or teeth 112 formed on the circumference thereof is the same as the number of teeth on the basic cam 20*a* and they are substantially aligned with each other. The pawl wheel 110 is rotated on the cam shaft 6 when the sewing machine is driven. Pawl 114 engaging the engaging parts 112 of the pawl wheel 110 is pivoted on a pin 115*a* provided on the button hold releasing cam 115 which is mounted on the cam shaft 6 and rotatable independently of the pattern cam group 20. A pin 114*a* on the pawl 14 has one end through a hole 115*b* formed in the button hole releasing cam 115, and the movement of the pin 114*a* is limited within the hole 115*b*. The lower end of the pin 114*a* engages a hole 116*a* of an auxiliary pawl 116 which is pivoted on the pin 115*a* on the underside of the button hole releasing cam 115 so as to be turnable together with the pawl 114. The pawl 114 is biased toward to the pawl wheel 110 and is engageable with one of the lobes the pawl wheel 110 as will be described hereinafter. The button hole releasing cam 115 is rotated with the pattern cam group 20 and is returned back to the initial position by means of a later mentioned spring when the pawl 114 is turned in the outward direction and is disengaged from the engaging part 112 of the pawl wheel 110.

Figures 56A, 56B:
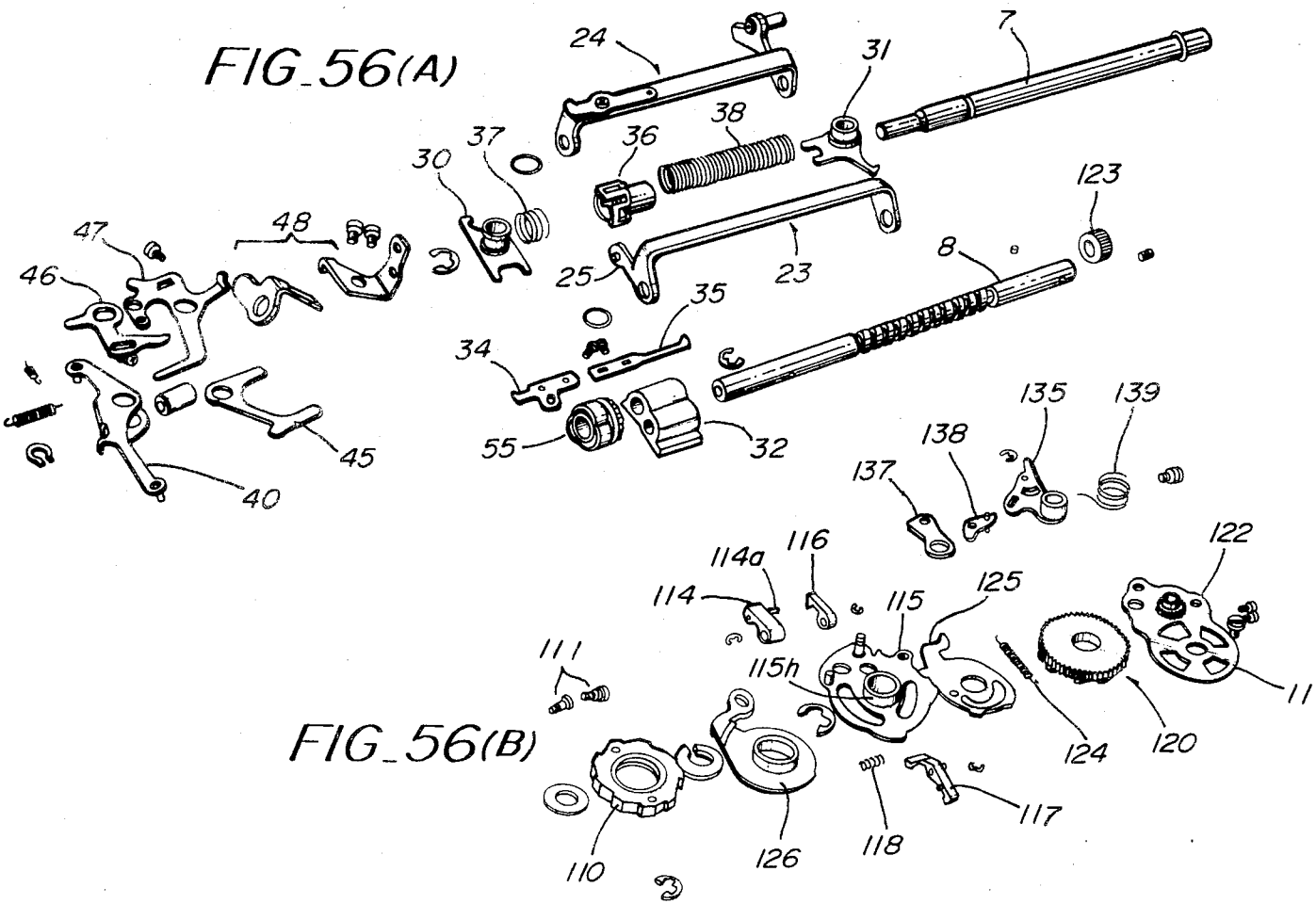

A feeding pawl 117 is pivoted on a pin 115*c* fixed to the button hole releasing cam 115 and is biased toward a feed pawl wheel 120 having teeth or engaging parts 120*a*–120*e* by means of a compression spring 118 provided between the rear end of the pawl 117 and the circumference of the button hole releasing cam 115. The feed pawl wheel 120 is integrated with a gear 121 as shown in FIGS. 56B and 57B and is rotatably mounted on the lowest part of the cam shaft 6 independently of the pattern cam group 20.

Figure 25:
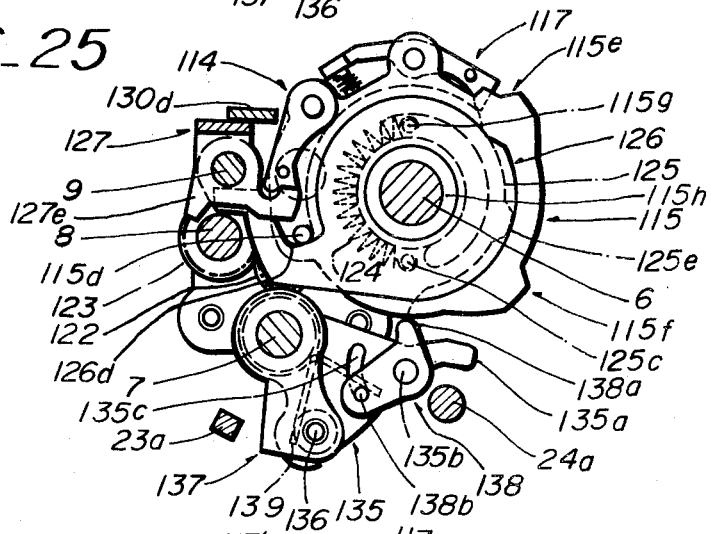

A gear 123 is fixedly mounted on the guide shaft 8 at the lowest part thereof, and an idler gear 122 is rotatably mounted on the base plate 11 between the gear 121 and the gear 123 and is in engagement with the gears 121 123 as shown in FIGS. 25 and 26.

The rotation movement of the pattern cam group 20 is transmitted to the feed pawl wheel 120, integrated with the gear 121, via the pawl wheel 110, the pawl 114, the button hole releasing cam 115 and the feeding pawl 117. The rotation movement of the feed pawl wheel 120 is transmitted to the guide shaft 8 via the gear 121, the idler gear 122 and the gear 123 so as to shift the cam followers 30 31 along the pattern cam group 20.

Figure 57A:
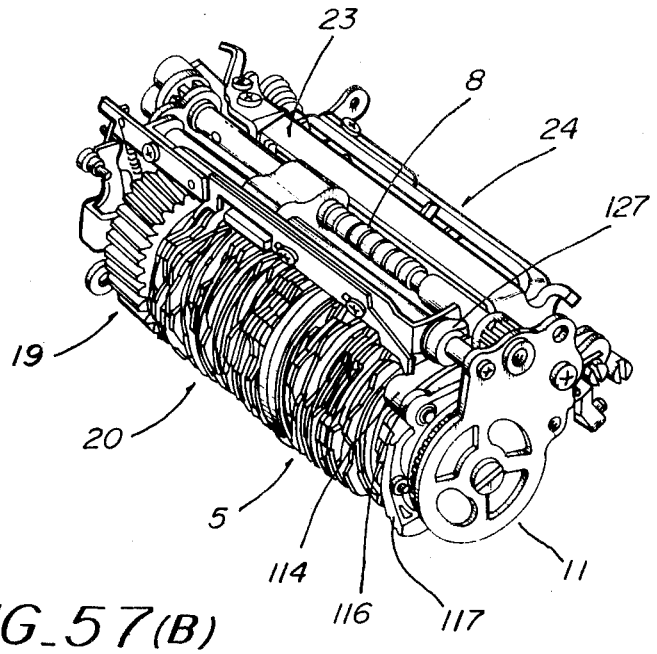
Figure 57B:
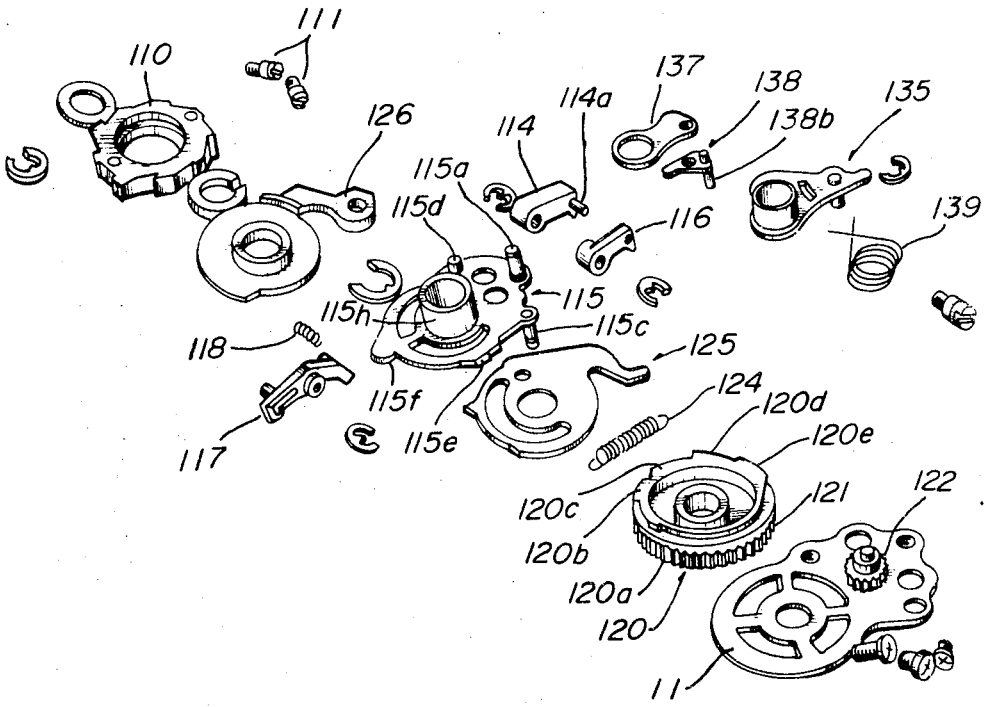
Figure 57C:
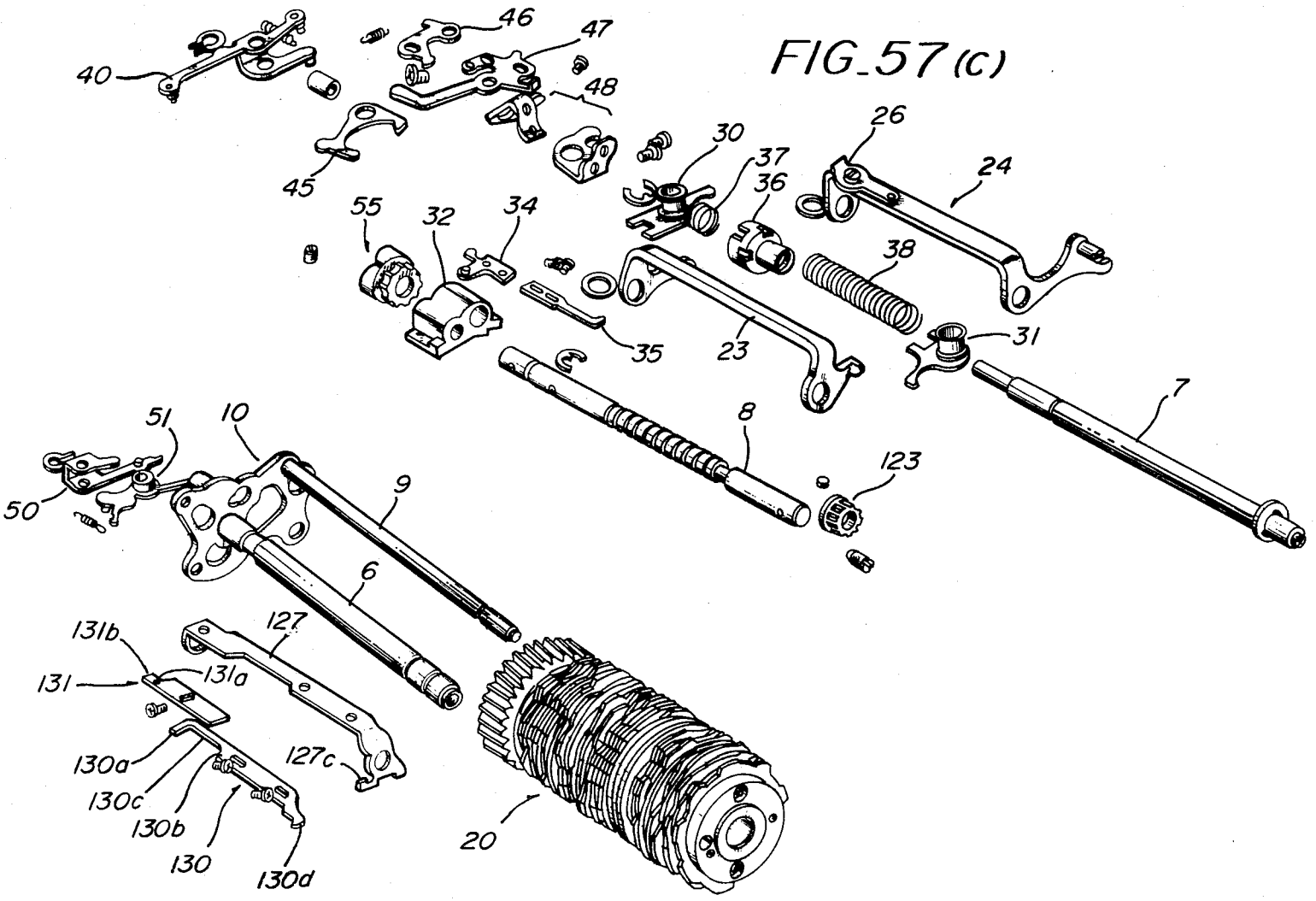

As shown in FIG. 57B, the button hole releasing cam 115 further has a pin 115*d* on the upper side thereof for determining the returning position of the cam 115, a pin 115*c* provided on the underside thereof to be engaged by one end of a spring 124, and lobes or engaging parts 115*e* 115*f* for releasing the cam followers 30 31 from the pattern cam group 20. The button hole releasing cam 115 is formed with a central boss 115*h* by which it is mounted on the cam shaft 6 rotatably independently of the pattern cam group 20 in the manner as mentioned hereinbefore.

Figure 36:
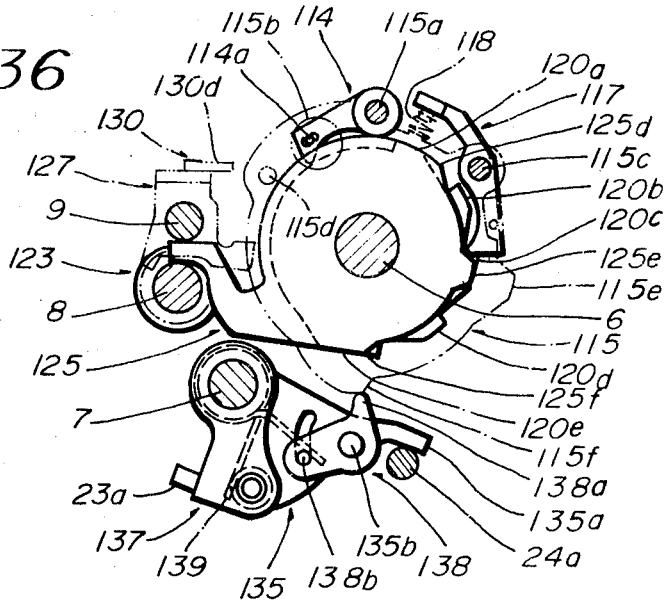
Figure 38:
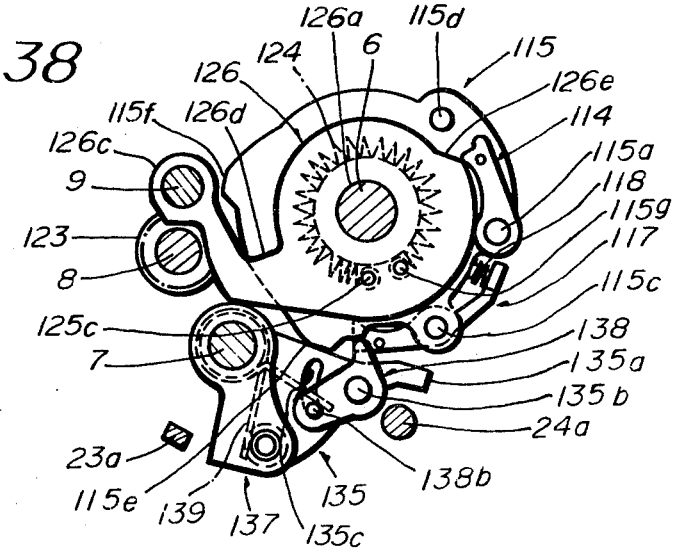
Figure 39:
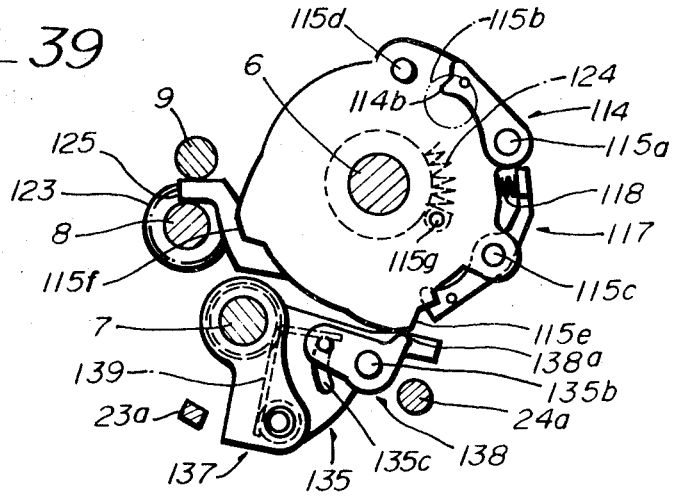
Figure 40:
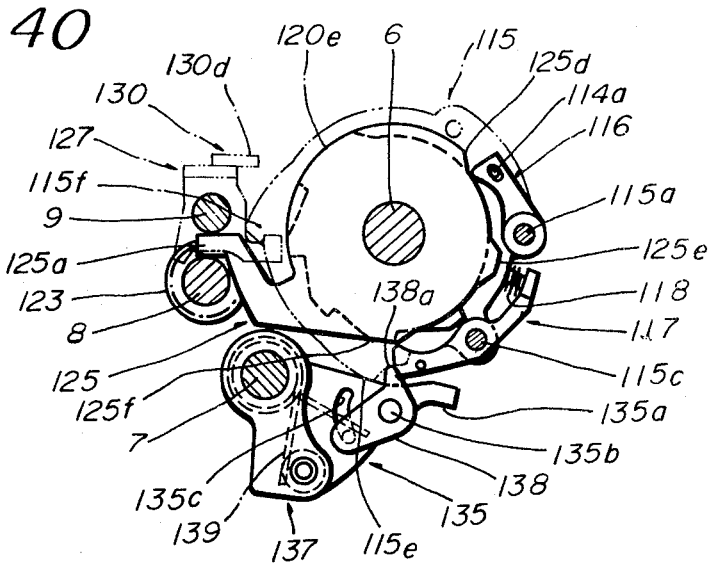
Figure 41:
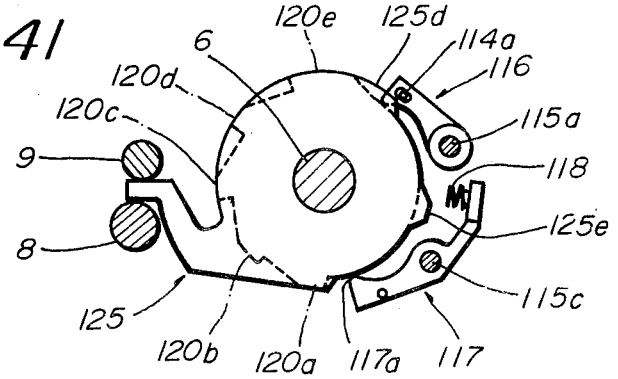
FIGS. 41 to 45 are explanatory plan views showing the operations of an automatic recovering device of this invention operating when an erroneous operation is made of the button hole stitching device of this invention.

In FIGS. 25, 26 and 36, numeral 125 is a stopping cam mounted on the cam shaft 6 and has an arm 125*a* which is positioned between the vertical shaft 9 and the guide shaft 8. Thus the stopping cam is prevented from rotation on the cam shaft. The stopping cam has a pin 125*c* on the upper side thereof. The pin 125*c* is engaged by the other end of the spring 124 which biases the button hole releasing cam 115 in the counterclockwise direction as shown in FIG. 38. The stopping cam 125 has cam portions 125*d*, 125*e* and 125*f*. When the end 117*a* of the feeding pawl 117 engages these cam portions 125*d*, 125*e* and 125*f*, the feeding pawl 117 is disengaged from the feed pawl wheel 120. Therefore, the button hole releasing cam 115 is rotated together with the pattern cam group 20 while the feed pawl wheel 120 is rotated stepwise an intermittently, thereby shifting the followers 30 31 stepwise along the pattern cam group 20.

Figure 32:
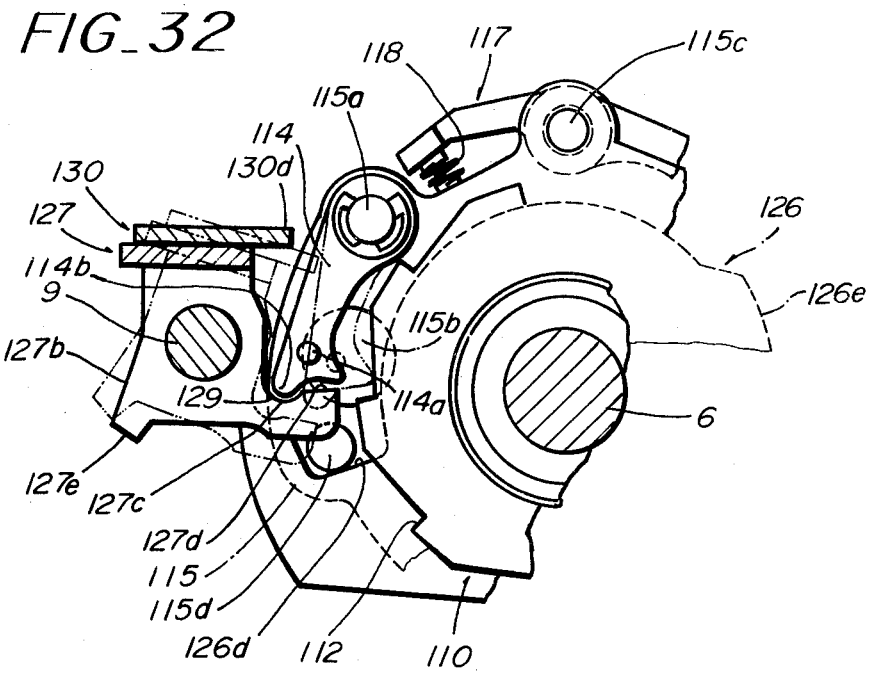

In FIG. 38, a pawl releasing cam 126 is mounted on the cam shaft 6 between the pawl wheel 110 and the button hole releasing cam 115. The pawl releasing cam 126 has an arm 126*c* which is in engagement with the vertical shaft 9. Therefore, the cam 126 is prevented from rotation. The arm 126*c* of the pawl releasing cam 126 has an engaging portion 126*d* as shown in FIGS. 25, 32 and 38 which stops the returning rotation of the button hole releasing cam 115 by engaging the pin 115*d* of the cam 115. The pawl releasing cam 126 has a cam portion 126*e* on the periphery thereof which is engaged by the pawl 114 and disengages the same from the pawl wheel 110, so that the button hole releasing cam 115 may be returned to the initial position by means of the spring 124 each time when one step of the button hole stitches is finished.

Figure 42:
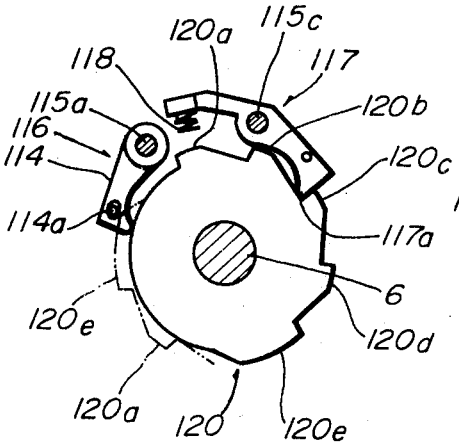
Figure 43:
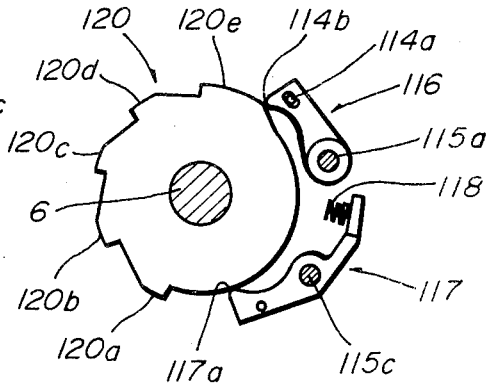
Figure 44:
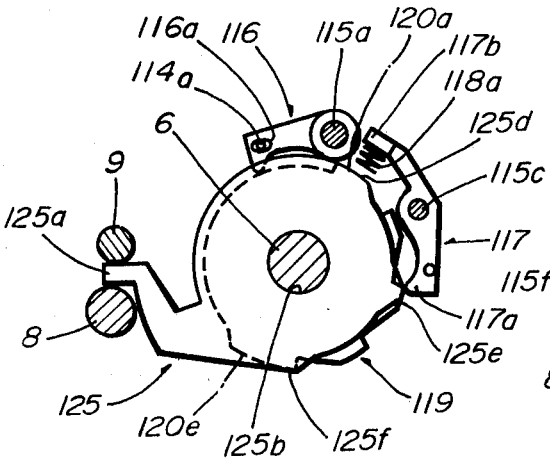
Figure 45:
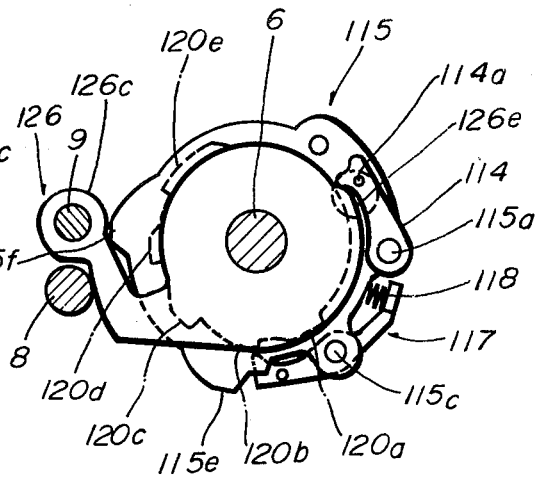

In FIGS. 42 and 43, as aforementioned, the feed pawl wheel 120 is rotatable around the cam shaft 6 and has the engaging parts 120*a*, 120*b*, 120*c* and 120*d* which are of the same shape and of the same pitch, and the engaging part 120*e* which is of a larger pitch. The engaging parts 120*c* and 120*d* are effective when the first half of a button hole is stitched (the first bartack and the leftside stitches of the button hole), and the engaging parts 120*a* and 120*b* are effective when the second half of a button hole is stitched (the second bartack and the rightside stitches). The engaging part 120*e* is effective to act on the aforementioned auxiliary pawl 116 and to release the pawl 114 from the pawl wheel 110, thereby returning the button hole releasing cam 115 to the initial position in FIG. 25, when an erroneous operation is made during stitching a button hole.

In FIGS. 2, 27 and 28, U-shaped selecting plate 127 is provided. The plate has upper and lower horizontal arms 127*a* and 127*b*, by which the plate 127 is turnably mounted on the vertical shaft 9 and is prevented from axial movement by means of a stopper ring 128 (FIG. 2) fixed on the shaft 9. As shown in FIG. 32 the lower arm 127*b* of the plate 127 is formed with a recess 127*c*, an engaging part 127*d* and a projection 127*e*. The recess 127*c* is adapted to engage the end 114*b* of the pawl 114 and pulls the pawl from the engagement with the pawl wheel 110 when the selecting plate 127 is turned in the counterclockwise direction. The projection 127*e* is adapted to engage the guide shaft 8 to stop the counterclockwise turning movement of the selecting plate 127.

As shown in FIGS. 2, 27 and 28, the moving element 32 is formed with an abutment 32*a*. A stopper plate 130 is fixedly mounted on the selecting plate 127 and has an upper bent stop arm 130*a*, a sloped step 130*b*, a recess 130*c* between the stop arm and the sloped step, a lateral projection 130*d* and a stop portion 130*e* between the step and the lateral projection. The lateral projection 130*d* is adapted to press the pawl 114 to the pawl wheel 110, so that the button hole stitches may be possible. The pressure is applied from a spring 134, one end of which is connected to an adjustable plate 131 fixed to the upper part of the selecting plate 127 and the other end is connected to a hole 50*b* of the U-shaped member 50 for biasing the selecting plate in the clockwise direction.

As shown in FIG. 6, the U-shaped member 50 is composed of a vertical wall, an upper arm having an engaging part 50*c* and a stepped part 50*d* and a depending pin 50*f*, and a lower arm having the hole 50*b*. The recovering arm 45 has a cam follower 45*a*, an actuating portion 45*b* and a hole 45*c* as shown, and as aforementioned the tension spring 54 is at one end connected to the hole 45*c* and at the other end connected to the projection 51*h* of the holding plate 51 so as to bias the recovering arm in the clockwise direction as shown in FIGS. 8 and 29.

Figure 29:
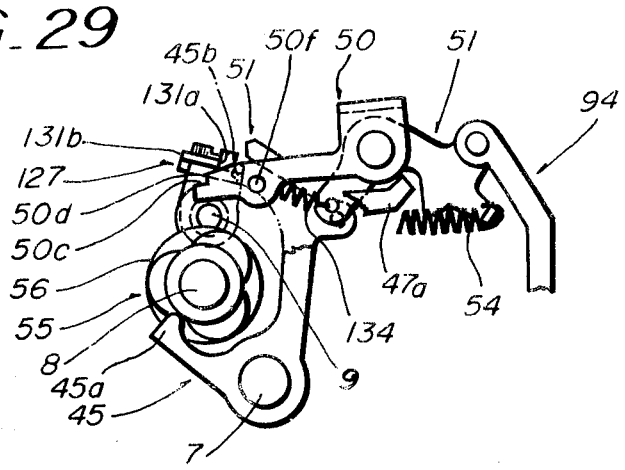
Figure 30:
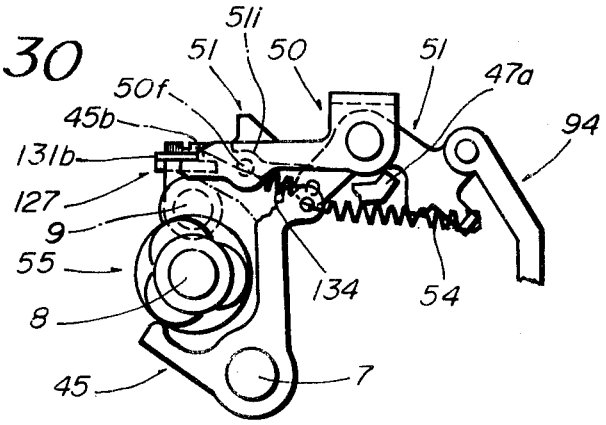
Figure 31:
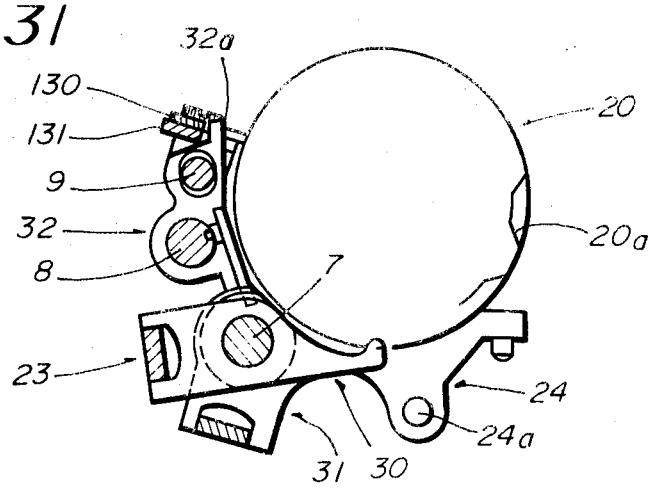
Figure 35:
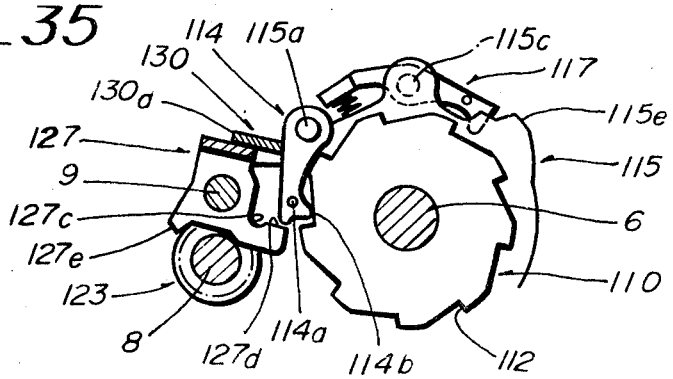
FIG. 35 to 40 are explanatory plan views of a button hole stitching device of this invention showing the actual operations thereof.

As shown in FIGS. 28 and 29, when button hole stitching is selected, the moving element 32 is positioned in the recess 130*c* of the stopper plate 130, the cam follower 45*a* of the recovering arm 45 is engagement with the lowest portion of the index cam 56 of the sprocket body 55 and the actuating portion 45*b* is in an inoperative position; and the stepped portion 50*d* of the U-shaped member 50 is located in an inoperative position, and therefore the selecting plate 127 is turned in the clockwise direction by the spring 134, and the lower projection 127*b* of the selecting plate 127 presses the pawl 114 to the pawl wheel 110 as shown in FIG. 35. Whem the moving element 32 is in the recess 130*c* of the stopper plate 130, the cam follower 31 is positioned opposite the basic pattern cam 20*a* and the cam follower 31 is positioned opposite the feeding cam 20*n*. When the moving element 32, namely the lower end of the abutment 32*a* is moved out of the recess 130*c* and engages the stopper portion of the stopper plate 130, the pressing action of the spring 134 is no longer transmitted to the pawl 114, and button hole stitching becomes impossible.

Figure 33:
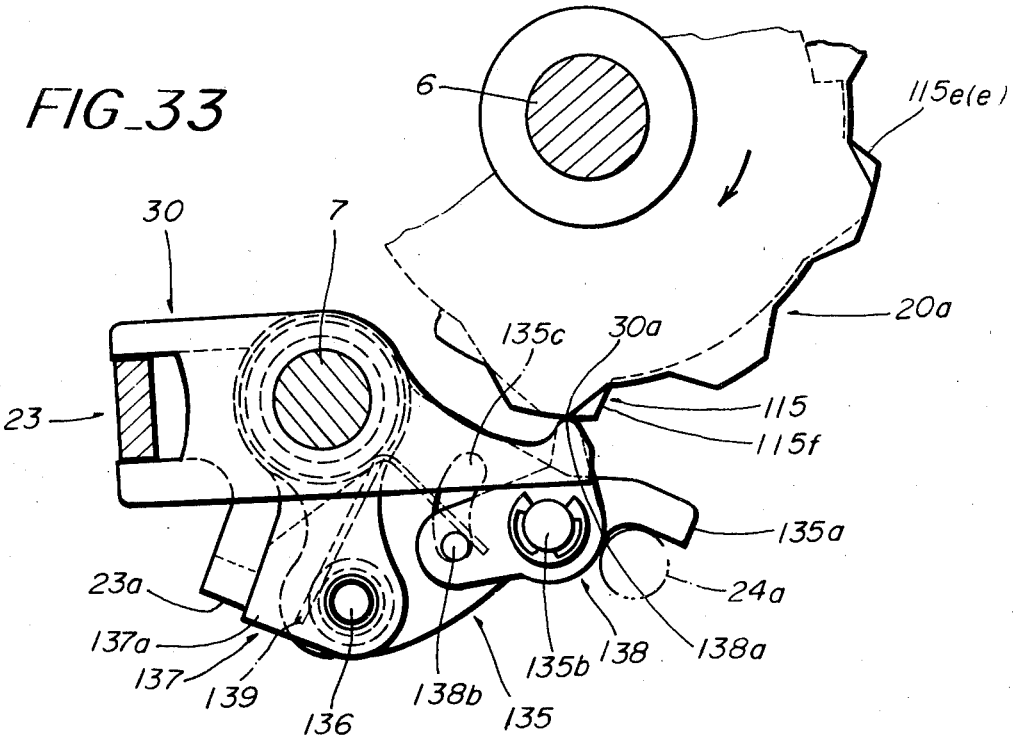
FIG. 33 is a plan view of a follower releasing device of this invention.

As shown in FIGS. 24, 25, 33 and 36, a button hole releasing arm 135 is turnably mounted on the lower end of cam shaft 7 and has an engaging end 135*a* which is engaged by a pin 24*a* depending from the laterally extended part of the U-shaped plate 24 of with the cam follower 31. Thus the button hole releasing arm 135 is biased toward the cam shaft 6. A plate 137 is fixed to the button hole releasing arm 135 by means of a screw 136. One end 137*a* of the plate 137 is adapted to engage a depending projection 23*a* of the U-shaped plate 23 of the cam follower 30. The depending projection is provided on the lower end of the U-shaped plate 23 as shown in FIG. 33. A releasing pawl 138 having an engaging end 138*a* is turnably mounted on a pin 135*b* fixed to the button hole releasing pawl 135. The releasing pawl 138 is biased in the counter-clockwise direction by means of a torsion spring 139 which is mounted around the follower shaft 7 and at one end engages a pin 138*b* on the pawl 138 and at the other end engages the screw 136. Since the pin 138*b* is positioned in an arcuate slot 135*c* formed in the button hole releasing arm, the turning angle of the releasing pawl is limited.

The releasing pawl 138 is engaged by the engaging parts of cam portions 115*f* and 115*e* of the button hole releasing cam 115 and is turned in the clockwise direction against the action of the torsion spring 139. Therefore, the button hole releasing arm 135 is turned in the clockwise direction, and accordingly the cam followers 30 31 are pulled back from the engaging cams respectively for a distance corresponding to the cam lifts of the respective cam portions 115*f* and 115*e*. When the button hole releasing cam 115 is returned in the counterclockwise direction to the initial position by the action of the spring 124, the releasing pawl 138 is turned idly against the action of the torsion spring 139.

In this invention, when the cam followers 30 31 are pulled back from the respective engaging cams 20, the cam follower 31 is pulled back to a position spaced from the circumference of the feeding cam 20*n*. However the cam follower 30 is pulled back to a position adjacent the top of the cam lift, namely the circumference of the greatest diameter of the basic pattern cam 20*a*, so as to eliminate irregular stitches on the left side portion of the button hole. Such a retreat of the cam follower 30 is obtained by an arrangement in which the cam lift of the cam portions 115*e* and 115*f* of the button hole releasing cam 115 is made the same with that of the basic pattern cam 20*a* and the cam portions 115*e* 115*f* are shifted in the counterclockwise direction relative to the projected cam portion of the basic pattern cam 20*a* as shown in FIG. 33.

As shown in FIG. 27, the cams to be used for stitching a button hole are arranged in the upper part and in the intermediate part of the cam group 20. The cams 20*a* 20*b* 20*c* and 20*d* are used as bight changing ones that determine stitch width and placement, and the cams 20*n* 20*u* 20*p* and 20*q* are used as feed changing ones.

Figure 46:
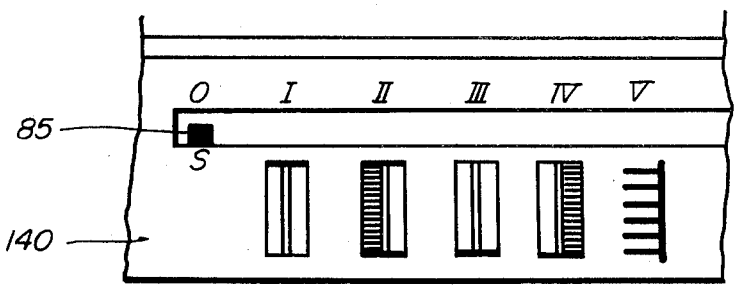
FIG. 46 is a front elevational view showing the indication of the button hole stitching selection.

As shown in FIG. 46, the first upper bartack stitches [I] of the button hole are made with the cams 20*a* and 20*n*, the left side stitches [II] of the button hole are made with the cams 20*b* and 20*u*, the second lower bartack stitches [III] are made with the cams 20*c* and 20*p*, and the right side stitches [IV] of the button hole are made with the cams 20*d* and 20*q*.

Figure 5:
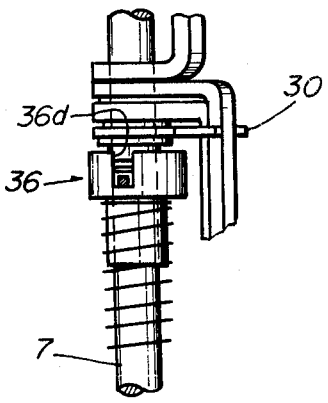
FIG. 5 is a front elevational view showing the spring receiving element mounted on the cam selecting device.

In this invention, the feeding cam 20*n* is twice as such as the basic pattern cam 20*a*. This is so because when the indicator 85 is set to the button hole starting position (S) in FIG. 46, the needle position is set to the left (among the left, center and the right); and if the bartack stitches [I] are sewn from the starting position of the indicator 85, one more basic cam 20*a* would actually be needed. Namely if the cam followers 30 and 31 are concurrently shifted during stitching the bartack stitches [I], it will be apparent that one more basic pattern cam 20*a* would be needed. In this invention, however one basic pattern cam 20*a* is enough to stitch the bartack [I] for the following reason; as shown in FIGS. 3A, 3C, and 5, even if the cam follower 30 is shifted to the uppermost position and stopped there, the plates 34 35 are still shiftable in the upward direction because the upper engaging part 34*a* is positioned in the opened vertical cutout 36*d* of the capsule 36 spaced from the bottom of the vertical cutout. Therefore when the moving element 32 is shifted downwardly, the lower follower 31 is instantly shifted in the same direction by the action of the compression spring, but the upper cam follower 30 still remains at the uppermost position even if the upper engaging part 34*a* of the plate 34 comes to engage the bottom of the vertical cutout 36*d* and shifts the capsule 36 in the downward drection against the action of the compression spring 37, because the followers 30 31 are normally pressed against the respective cams with a stronger force by the respective tension springs (not shown). The cam follower 30 is, therefore, not moved when the guide shaft is rotated, and is moved instantly only when it is released from the basic pattern cam 20*a* by the compression spring 37. The cam follower 30 remains opposite the basic pattern cam 20*a* while the cam follower 31 is shifted along the feeding cam 20*n*. This is the reason why the bartack stitches [I] are made with the cam 20*a* and cam 20*n*.

Operation of the button hole stitching device

The selection of button hole stitching is as follows; when the dial 73 is rotated, the cam follower releasing cam 76 is rotated to turn the unit of the releasing plate 46, the holding lever 47 and the releasing arm 48, in the clockwise direction in FIGS. 7 to 9. Then the cam followers 30 31 are pulled back from the respective cams of the cam group 20 and the holding lever is held by the holding plate 51. After further rotation of the cam 76, the cam 76 is axially displaced by the compression spring 63 to connect the clutch ring 65 to the rotary member 67.

Then the rotation movement of the dial 73 is transmitted to the sprocket body 56 via the gear 91 on the transmission shaft 90, the gear 92 and the belt 93. Thus the guide shaft 8 is rotated to shift the cam followers 30 31 in the upward direction until the moving element 32 is positioned in the recess 130*c* of the stopper plate 130. At the same time, the gear with the pawl wheel 120 is rotated via the guide shaft 8, the gear 123 on the guide shaft 8 and the idler gear 122.

In the meantime, when the holding lever 47 turns the holding plate in the counter-clockwise direction on the way it engages the engaging part 51*g* of the holding plate 51, the arm 51A of the holding plate 51 pushes the depending pin 50*f* of the U-shaped member 50 and once disengages the stepped part 50*d* of the member 50 from the upper edge 131*b* of the adjustable plate 130 on the selecting plate 127 against the action of the spring 134 (FIGS. 6, 7 and 8); but the selecting plate 127 is not turned in the clockwise direction by the action of the tension spring 134 while the moving element 32 is still out of the recess 130*c* of the stopper plate 130 and the abutment 32*a* of the moving element 32 engages the stop portion 130*e* of the stopper plate 130; soon the stepped part 50*d* of the member 50 is returned to the position engaging the upper edge 131*b* of the adjustable plate 130.

In this position, the pawl 114 is in engagement with the recess 127*c* of the lower arm 127*b* of the selecting plate 127 and is retracted from the pawl wheel, and accordingly the auxiliary pawl 116 is held back from the feed pawl wheel 120 as shown in FIG. 32.

Figure 4:
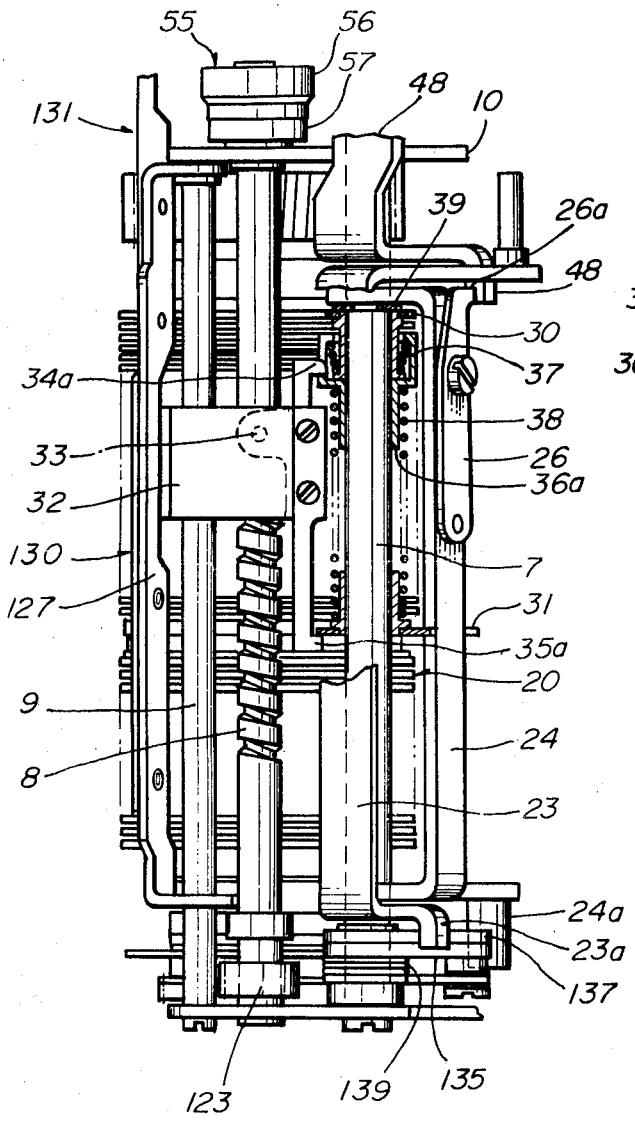
FIG. 4 is a front elevational view of a cam selecting device of this invention.

In FIG. 3A, with further rotation of the guide shaft 8, the moving element 32 is shifted in the upward direction. The cam follower 30 is stopped in the uppermost position when it abuts the stop ring 39 on the vertical shaft 7. However the moving element 32 continues to move a little against the action of the compression spring 38 until the cam follower 31 is shifted one step more in the upward direction along the feeding cam 20*n*, and the moving element 32 is stopped when the upper end of the abutment 32*a* engages the stop arm 130*a* of the stopper plate 130 (FIG. 4).

Figure 47:
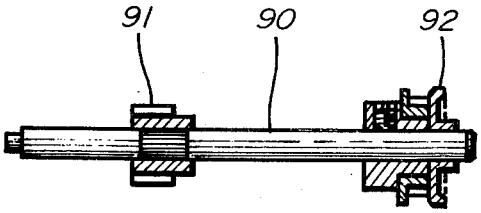
FIG. 47 is a partly sectional side elevational view of a transmission device of this invention, which transmits a movement to a selecting indicator and to the cam followers.

In this position, the pattern indicator 85 has been brought to the button hole starting position [S] shown in FIG. 47, and all parts of the mechanism are stopped.

Also in this position, the moving element 32 and accordingly the abutment 32*a* is in the recess 130*c* of the stopper plate 130, but the selecting plate 127 is still not turned in the clockwise direction by the action of the tension spring 134, because the stepped part 50*d* of the U-shaped member 50 is in engagement with the upper edge 131*b* of the adjustable plate 130 on the selecting plate 127, and the cam follower 31 is positioned opposite the upper part of the feeding cam 20*n* in FIG. 27.

In this position, the feed pawl wheel 120 is positioned as shown in FIG. 24 relative to the stopping cam 125 in FIG. 25, The cam follower 45*a* of the recovering arm 45 is in engagement with the lowest portion of the index cam 56 of the sprocket body 55 and the actuating finger 45*b* of the recovering arm 45 is in a position spaced from the upper part of the adjustable plate 131 as shown in FIGS. 6 and 8.

Then when the dial 73 is axially pushed to turn the holding plate 51 in the counter-clockwise direction, the holding lever 47 is released from the holding plate 51 and therefore the cam followers 30 31 engage the pattern cam 20*a* and the feeding cam 20*n* respectively. Simultaneously the arm 51A of the holding plate 51 pushes the pin 50*f* of the U-shaped member 50 to release the stepped part 50*d* of the member 50 from the upper edge 131*b* of the adjustable plate 131 on the selecting plate 127. The selecting plate 127, therefore, is turned in the clockwise direction by the tension spring 134 until the adjustable plate 131 is blocked by the actuating finger 45*b* of the recovering arm 45; then the lower arm 27*b* of the selecting plate is pulled back from the pawl 114 as shown in dot-dash lines in FIG. 32, and the free end 114*b* is released from the recess 127*d* of the arm 127*b;* and then the lower projection 130*d* of the stopper plate 130 on the selecting plate 127 pushes the pawl 114 into engagement with the pawl wheel 110.

Figure 34:
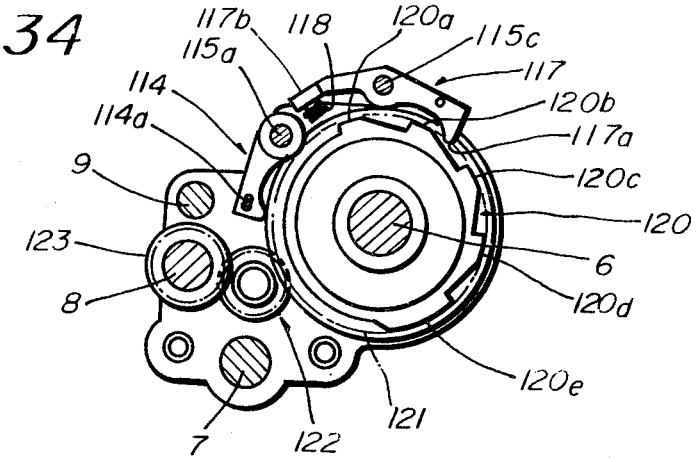
FIG. 34 is a plan view of an automatic transmission device of this invention.

When the sewing machine is driven, the feed pawl wheel 110 is rotated together with the cam group 20 in the clockwise direction; then the button hole releasing cam 115 is rotated with the feeding pawl 117 via the pawl 114; then the feeding pawl 117 comes to engage the circumference of smaller diameter of the stopping cam 125 from the circumference of the largest diameter of the stopping cam 125, and comes to engage the engaging part 120*c* of the feed pawl wheel 120 to rotate the wheel 120 as shown in FIGS. 34 and 42; in the meantime the engaging part 115*f* of the button hole releasing cam 115 engages the releasing pawl 138 as shown in FIG. 36, and the cam followers 30 31 are pushed back from the cams 20*a* and 20*n* respectively, and simultaneously the guide shaft 8 is rotated, and the moving element 32 starts to descend. As the guide shaft 8 is rotated, the index cam 56 is rotated in the clockwise direction. Therefore the follower 45*a* of the recovering arm 45, which has been in engagement with the lowest part of the index cam 56, is turned in the counter-clockwise direction by the rising portion of the index cam, and the actuating finger 45*b* of the recovering arm 45 pushes the adjustable plate 131 in the counter-clockwise direction against the action of the spring 134 and allows the U-shaped member 50 to turn in the clockwise direction. Thus the stepped part 50*d* of the member 50 engages the upper edge 131*b* of the adjustable plate 131. Therefore, the lower projection 130*d* of the stopper plate 130 on the selecting plate 127 is held in a position spaced from the pawl 114. On the other hand, the pawl 114 is kept in engagement with one of the engaging parts 112 of the pawl wheel 110 by the action of the tension spring 124 as shown in FIGS. 27, 28, 29 and 30.

When as shown in FIG. 36 the feeding pawl 117 comes to engage the cam portion 125*e* of the stopping cam 125, the pawl 117 is pushed back from the engaging part 120*c* of the feed pawl wheel 120, and the feed pawl wheel 120 stops. In the meantime, almost the half of the first upper bartack stitches [I] in FIG. 46 have been sewn, and in this instant the cam follower 30 engages the basic cam 20*a* as aforementioned and the cam follower 31 engages the lower part of the feeding cam 20*n*.

Figure 37:
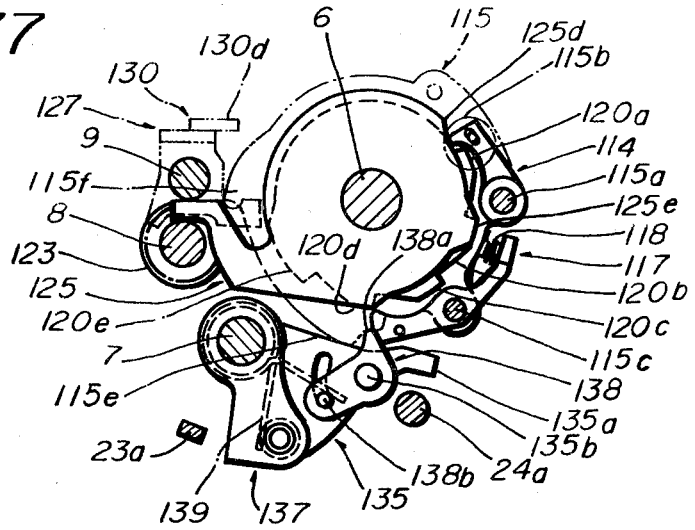

With further rotation as shown in FIG. 37 of the button hole releasing cam 115, the feeding pawl 117 comes to engage the circumference of smaller diameter of the stopping cam 125 from the cam portion 125*e* thereof, and engages the next engaging part 120*d* of the feed pawl wheel 120 and rotates the feed pawl wheel 120; in the meantime the engaging part 115*e* of the button hole releasing cam 115 engages the releasing pawl 138. The cam followers 30 31 are therefore momentarily pulled back from the cams 20*a* 20*n* respectively and start to come down again. With further rotation of the feed pawl wheel 120 and the button hole releasing cam 115, the feed pawl 117 comes to engage the cam portion 125*f* of the stopping cam 125, and is retreated from the engaging part 120*d* of the feed pawl wheel 120, and the feed pawl wheel 120 stops.

With further rotation of the button hole releasing cam 115, when the pawl 114 comes to engage the cam portion 126*e* of the pawl releasing cam 126 as shown in FIG. 38, the pawl 114 is pushed away from the pawl wheel 110, and therefore the button hole releasing cam 115 is returned to the initial position by the action of the tension spring 124 as shown in FIGS. 24, and 25 in which the returning rotation of the button hole releasing cam 115 is stopped by the pin 115*d* on the cam 115 which engages the engaging portion 126*d* of the pawl releasing cam 126.

In the meantime, the first upper bartack stitches [I] in FIG. 46 have been completely sewn; the cam follower 30 has been shifted to a position opposite the cam 20*b* and the cam follower 31 to a position opposite the cam 20*n* in FIG. 46; and the pattern indicator 85 has been brought to the position [II] for stitching the left side stitches of the button hole; and in this instance the follower 45*a* of the recovering arm 45 is positioned in the lowest portion of the index cam 56. As will be apparent from the aforementioned description, the automatic shifting of the pattern indicator 85 is carried out via the index cam 56, the belt 93, the gear 92, the transmission shaft 90, the gear 91, the rotary member 67 and the timing belt 84 on which the indicator 85 is attached as will be mentioned hereinafter.

It will be apparent that the button hole releasing cam 115, which is rotated with the cam group 20, pushes the cam followers 30 31 from the cam group 20 by means of the engaging parts 115*f* and 115*e* respectively, and the rotation of the feed pawl wheel 120 shifts the cam followers 30 31 along the cam group 20.

By continuously driving the sewing machine after the first upper bartack stitches have been sewn, the left side stitches [II] of the button hole are sewn limitlessly as long as the sewing machine is driven by the pattern cam 20*b* and the feeding cam 20*n*, because as aforementioned the selecting plate 127 is held in an inoperative position in which the lower projection 130*d* of the stopper plate 130 on the selecting shaft applies no pressure to the pawl 114 to engage the pawl wheel 110 and therefore the button hole releasing cam 115 is not rotated while the pattern cam group 20 is rotated.

When the dial 73 is axially pushed after the left side stitches [II] of the button hole have been sewn in a proper length, the selecting plate 127 is released as aforementioned via the holding plate 51 which acts on the U-shaped member 50, and the selecting plate 127 is turned in the clockwise direction by the tension spring 134. The pawl 114 is, therefore, pressed to the pawl wheel 110 by the lower projection 130*d* of the stopper plate 130 on the selecting plate 127, and the button hole releasing cam 115 becomes operative again.

When the sewing machine is driven again, the button hole stitching mechanism repeats an operating cycle in the manner described above; and the second bartack stitches [III] in FIG. 46 are stitched by the pattern cam 20*c* and the feeding cam 20*p*, and then the right side stitches [IV] of the button hole are stitched in reversed feed by the pattern cam 20*d* and the feeding cam 20*q*.

Pulling back of the cam follower 30 is limited to the top of the cam lift of the basic pattern cam 20*a*, namely the circumference of the largest diameter of the cam 20*a* so as to make the needle drop constant on the left side stitches of the button hole. For this purpose, as shown in FIG. 33, the cam lifts 115*e* 115*f* of the button hole releasing cam 115, which are same as the respective cam lifts of the basic pattern cam 20*a* are shifted relative to those of the cam 20*a* in the counter-clockwise direction, so that the end 30*a* of the cam follower 30 will come down from the cam lift of the basic pattern cam 20*a* while the end 38*a* of the releasing pawl 138 engages the cam lift of the button hole releasing cam 115. Thus the cam follower 30 is kept in a released position until the releasing pawl 138 comes down from the cam lift 115*f*. The cam follower 30 is, therefore, shifted along the cam group 20 for selecting a new cam.

When the right side stitches of the button hole have been sewn in the reversed feed until they are connected to the first upper bartack [I], the button hole is finished. If another button hole is desired, the dial 73 is rotated to shift the pattern indication to the button hole starting position [S] again and the dial is axially pushed.

In this invention, it is possible to reset the button hole stitching mechanism to the first starting position in the half way of button hole stitching. For this purpose, as aforementioned, the auxiliary pawl 116 is provided. The pawl is substantially the same shape and same size with the pawl 114 and arranged on the underside of the button hole releasing cam 115 completely in association with the pawl by means of the pins 115*a* and 114*a* in FIGS. 24, 40 to 45.

In the half way of button hole stitching, if the dial 73 is rotated in the clockwise or counter-clockwise direction, the feed pawl wheel 120 is rotated accordingly, and the engaging part 120*a* or the engaging part 120*e* engages the auxiliary pawl 116. The pawl 114 is, therefore, retreated from the pawl wheel 110; and the button hole releasing cam 115 is returned in the initial position as shown in FIGS. 24 and 25 by the action of the tension spring 124.

FIGS. 49A-53 show a pattern indicating device of this invention. A timing belt 84 is mounted around the sprocket 82 of the rotary member 67 and around a sprocket 86 rotatably mounted on the machine frame 1 at a position spaced from the sproket 82. Above the timing belt 84, an elongated guide plate 89 is mounted on the machine frame 1. The guide plate is formed with an elongated guide groove along the belt 84. The pattern indicator 85 has a bass 85*a* which is inserted into a groove 89*a* of the guide plate 89. The boss 85*a* is fixedly connected to a support 87 by means of a pair of screws 88. The support is formed with a pair of lower U-shaped ends 87*a* which fittedly engage the spaces respectively between teeth of the timing belt 84, so that the pattern indicator may be moved in the elongated groove 89*a* together with the timing belt without the risk of bending the timing belt. The both ends 89*c* 89*d* of the groove 89*a* of the guide plate 89 determine the range within which the indicator is moved, and also determine the upper and lower limits for the movement of the cam followers 30 31 along th cam group 20.

I claim:

1. In a sewing machine wherein a shaft rotates relative to a machine frame in order vertically to reciprocate a needle and to rotate a pack of pattern cams, and wherein two cam followers are displaceable axially along said pack and are engageable radially with said cams for controlling the stitch pattern of said needle, a buttonholer comprising:

releasing means connectable to said pack and to said followers and rotatable by said pack from a starting position through predetermined first angular positions of said pack for displacing said followers from an engaged position riding on respective cams into a disengaged position clear of said cams only when said pack is in said first positions;

clutch means for coupling said releasing means to said packs;

shifting means connected to said releasing means for displacing said followers axially along said pack each time said releasing means displaces said followers from said engaged to said disengaged position;

stopper means connected between said releasing means and said shifting means for disconnecting same from each other in a predetermined second position which said pack assumes after passing through said first position;

clearing means for disconnecting said releasing means from said pack and returning said releasing means to said starting position;

setting means connected to said releasing means and displaceable between an operative position allowing displacement of said releasing means from said starting position and an inoperative position blocking displacement of said releasing means from said starting position; and operating means including an operating element connected to said clutch means and to said releasing means and displaceable from a normal position to an actuated position for simultaneous displacement of said cam followers into said engaged position and coupling of said releasing means to said pack.

2. The buttonholer defined in claim 1 wherein said pack of cams includes a set of feed-control cams associated with one of said followers and a set of needle-control cams associated with the other of said followers, each of said sets including at least two buttonhole cams, said setting means including means for axially displacing said followers to positions adjacent said buttonhole cams.

3. The buttonholer defined in claim 2 wherein said releasing means includes a releasing cam rotatable with said pack.

4. In a sewing machine wherein a shaft rotates relative to a machine frame in order vertically to reciprocate a needle and to rotate a pack of pattern cams including a set of feed-control cams and a set of needle-control cams, wherein two cam followers one of which is associated with said feed-control cams and the other of which is associated with said needle control cams are displaceable axially along said pack and are engageable radially with said cams for controlling the stitch pattern of said needle, and wherein each of said sets includes at least two buttonhole cams, a buttonholer comprising:

releasing means connectable to said followers and including a releasing cam rotatable with said pack from a starting position through predetermined first angular positions of said pack for displacing said followers from an engaged position riding on respective cams into a disengaged position clear of said cams only when said pack is in said first positions, said releasing means including a first pawl on said releasing cam and a toothed wheel carried on said pack, said first pawl being radially engageable with said toothed wheel and being rotationally coupled to said releasing cam;

shifting means connected to said releasing means for displacing said followers axially along said pack each time said releasing means displaces said followers from said engaged to said disengaged position;

stopper means connected between said releasing means and said shifting means for disconnecting same from each other in a predetermined second position which said pack assumes after passing through said first positions;

clearing means for disconnecting said releasing means from said pack and returning said releasing means to said starting position; and setting means connected to said releasing means and displaceable between an operative position allowing displacement of said releasing means from said starting position and an inoperative position blocking displacement of said releasing means from said starting position said setting means including means for axially displacing said followers to positions adjacent said buttonhole cams.

5. The buttonholer defined in claim 4 wherein said sewing machine includes an adjustment element and means between said adjustment element for displacing said followers axially along said pack of cams, said buttonholer further comprising means interconnecting said adjustment element and said setting means.

6. The buttonholer defined in claim 5 wherein said shifting means includes a shifting wheel rotatable with and relative to said pack, means connecting said shifting wheel to said followers for axially displacing said followers on rotation of said shifting wheel, and a second pawl on said releasing cam engageable with said shifting wheel for rotationallly interconnecting said shifting wheel and said releasing cam.

7. The buttonholer defined in claim 6 wherein said shifting means includes a shifting cam adjacent said releasing cam and having a lobe engageable with said second pawl in said first positions to displace said second pawl out of contact with said shifting wheel.

8. The buttonholer defined in claim 7 wherein said clearing means includes a clearing cam adjacent said releasing cam and having a lobe engageable with said first pawl for disconnecting same from said toothed wheel in said second position, and a spring urging said releasing cam into said starting position.

9. The buttonholer defined in claim 8 wherein said clearing cam is nonrotatable relative to said pack.

10. The buttonholer defined in claim 8, further comprising interrupting means including means for displacing said first pawl out of contact with said toothed wheel on actuation of said adjustment element with said followers in said engaged position with said buttonhole cams.

11. The buttonholer defined in claim 8 wherein said pattern cams displace said followers radially between outer positions and inner positions and said shifting cam also displaces said followers radially into positions generally corresponding to said outer positions.

12. The buttonholer defined in claim 8 wherein said followers are provided with a pivotal plate riding on said shifting cam.

13. The buttonholer defined in claim 8 wherein said releasing cam is displaceable through less than 360° between said starting position and said second position.

14. The buttonholer defined in claim 8 wherein said pawls have ends turned angularly away from each other and engageable with the respective wheels.

15. The buttonholer defined in claim 8 wherein one of said buttonhole cams of one of said sets is substantially axially twice as thick as any of the other buttonhole.

16. The buttonholer defined in claim 8, further comprising indicating means including a belt connected to said adjustment element, an array of pattern indicia on said machine, and a pointer on said belt displaceable thereby along said array of indicia.

17. The buttonholer defined in claim 16 wherein one such indicium is provided for each of said cams of one of said sets.

18. The buttonholer defined in claim 16 wherein said indicating means further comprises at least one idler wheel on said frame, said belt being toothed and spanned over said idler wheel.

* * * * *